US010094110B2

(12) United States Patent
Gomes et al.

(10) Patent No.: US 10,094,110 B2
(45) Date of Patent: Oct. 9, 2018

(54) MASONRY WALL ASSEMBLY

(71) Applicants: Board of Regents, The University of Texas System, Austin, TX (US); Dabney Staub Gomes, Austin, TX (US)

(72) Inventors: Francisco Henning Gomes, Austin, TX (US); Dabney Staub Gomes, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 15/434,770

(22) Filed: Feb. 16, 2017

(65) Prior Publication Data

US 2017/0247879 A1 Aug. 31, 2017

Related U.S. Application Data

(60) Provisional application No. 62/300,766, filed on Feb. 26, 2016.

(51) Int. Cl.
*E04B 2/22* (2006.01)
*E04B 2/24* (2006.01)
(Continued)

(52) U.S. Cl.
CPC ..... *E04B 2/22* (2013.01); *E04B 1/30* (2013.01); *E04B 2/24* (2013.01); *E04C 1/00* (2013.01);
(Continued)

(58) Field of Classification Search
CPC ..... E04B 2/22; E04B 1/30; E04B 2/24; E04B 1/7612; E04B 2103/02; E04B 2002/0256; E04C 1/00; E04C 1/397
See application file for complete search history.

(56) References Cited

U.S. PATENT DOCUMENTS 1,064,498 A * 6/1913 Landis ..... E04B 2/12 52/125.3
1,485,007 A 2/1924 Zahn et al.
(Continued)

FOREIGN PATENT DOCUMENTS

GB 882577 A 11/1961

OTHER PUBLICATIONS

Non-Final Office Action issued in U.S. Appl. No. 15/272,600, dated May 3, 2017.
(Continued)

*Primary Examiner* — Jeanette E Chapman
(74) *Attorney, Agent, or Firm* — Meunier Carlin & Curfman LLC

(57) ABSTRACT

Various implementations are directed to a single face building block and masonry wall assembly and methods. Each building block includes a single face shell, first and second webs extending from an interior surface of the face shell, and a pier that has a proximal surface disposed between distal ends of the webs and a distal surface that is opposite and spaced apart from the proximal surface of the pier. Interior surfaces of the webs, the proximal surface of the pier, and a portion of the interior surface of the face shell between the webs define a pocket. In addition, the building blocks may include a ledge that extends outwardly from the distal surface of the pier. This ledge forms a channel with an upper surface of the pier stacked above the block.

26 Claims, 34 Drawing Sheets

(51) Int. Cl.

| | |
|---|---|
| ***E04C 1/00*** | (2006.01) |
| ***E04C 1/39*** | (2006.01) |
| ***E04B 1/30*** | (2006.01) |
| *E04B 2/02* | (2006.01) |
| *E04B 1/76* | (2006.01) |

(52) U.S. Cl.
CPC ..... *E04C 1/397* (2013.01); *E04B 1/7612* (2013.01); *E04B 2002/0256* (2013.01); *E04B 2103/02* (2013.01)

(56) References Cited

U.S. PATENT DOCUMENTS 1,675,093 A 6/1928 Conley et al.
2,008,775 A * 7/1935 Staman ..... E04B 1/41 52/284
2,684,589 A 7/1954 Perreton
2,881,613 A 4/1959 Johnson et al.
2,929,236 A 3/1960 Steward et al.
3,222,830 A 12/1965 Ivany et al.
3,233,380 A * 2/1966 Rosenfeld ..... E04B 2/12 52/425
3,418,774 A * 12/1968 Kocher ..... E04B 2/22 52/437
3,562,988 A 2/1971 Gregoire
3,968,615 A 7/1976 Ivany et al.
4,074,832 A * 2/1978 McCarthy ..... B65D 88/66 222/245
4,123,881 A * 11/1978 Muse ..... E04B 2/44 52/100
4,167,840 A 9/1979 Ivany et al.
4,640,071 A 2/1987 Haener et al.
4,655,018 A 4/1987 Pardo et al.
4,704,832 A 11/1987 Vassiliadis et al.
4,986,049 A 1/1991 Kennedy et al.
5,007,218 A 4/1991 Bengtson et al.
5,066,440 A 11/1991 Kennedy et al.
5,138,808 A 8/1992 Bengtson et al.
5,163,261 A 11/1992 O'Neill et al.
5,209,037 A 5/1993 Kennedy et al.
5,321,926 A 6/1994 Kennedy et al.
5,484,235 A * 1/1996 Hilfiker ..... E02D 17/205 405/262
5,528,874 A 6/1996 Schmid et al.
5,848,235 A * 12/1998 Scott ..... G01R 31/2815 714/30
5,901,520 A 5/1999 Abdul-Baki et al.
6,065,265 A 5/2000 Stenekes
6,082,067 A 7/2000 Bott
6,223,493 B1 5/2001 Ruggeri et al.
6,250,038 B1 * 6/2001 Akamine ..... E02D 29/02 52/421
6,513,293 B2 2/2003 Miller et al.
6,735,915 B1 5/2004 Johnson et al.
6,978,581 B1 12/2005 Spakousky et al.
7,086,811 B2 * 8/2006 Lewis ..... E02D 29/0216 405/262
7,096,636 B1 8/2006 Neill et al.
D530,832 S 10/2006 Rainey et al.
D574,517 S 8/2008 Foster et al.
7,497,646 B2 3/2009 Price et al.
7,739,841 B1 6/2010 Puckett et al.
7,739,845 B2 * 6/2010 Kennedy ..... E04C 1/41 52/309.12
D626,662 S 11/2010 Bott et al.
7,823,360 B1 * 11/2010 Cottle ..... E04B 2/42 52/604
D632,805 S 2/2011 Bott et al.
D636,897 S 4/2011 Bott et al.
8,266,855 B1 9/2012 Altararwah
8,800,235 B2 10/2014 Lacroix et al.
9,476,200 B2 * 10/2016 Gomes ..... E04B 2/22
D794,832 S * 8/2017 Gomes ..... D25/114
2006/0059839 A1 3/2006 Azar et al.
2006/0150559 A1 7/2006 Haener et al.
2010/0018150 A1 1/2010 Azar et al.
2010/0043335 A1 2/2010 O'Connor et al.
2012/0167516 A1 7/2012 Dyson et al.
2014/0174013 A1 6/2014 Hohmann, Jr. et al.
2014/0373479 A1 * 12/2014 Karau ..... B28B 7/00 52/588.1
2015/0052837 A1 * 2/2015 Gomes ..... E04B 2/22 52/405.3

OTHER PUBLICATIONS

Non-Final Office Action issued in U.S. Appl. No. 14/465,421, dated Feb. 26, 2016.
National Concrete Masonry Association "NCMA TEK 14-20A" , Structural (2002).
National Concrete Masonry Association "NCMA TEK 3-14", Construction (2002).
Inglesby, et al., "Pass the Post, Please", Mason Contractors Association of America, Sep. 16, 2002; 4 pp.
Olstag, William Peter "Post-Tensioned Single Wythe Concrete Masonry Walls," May 1986, A Thesis in Architectural Engineering, The Pennsylvania State University, The Graduate School, Department of Architectural Engineering.
U.S. Pat. No. 9,476,200, which issued on Oct. 25, 2016, and was filed as U.S. Appl. No. 14/465,421, filed Aug. 21, 2014, and its file history.
Co-pending U.S. Appl. No. 15/272,600, filed Sep. 22, 2016, and its file history.
Co-pending U.S. Appl. No. 29/556,139, filed Feb. 26, 2016, and its file history.
Office Action issued in Design U.S. Appl. No. 29/556,139, dated Nov. 25, 2016.

* cited by examiner

MASONRY WALL ASSEMBLY

CROSS REFERENCE TO RELATED APPLICATION

This application claims priority to U.S. Provisional Patent Application No. 62/300,766, entitled "Masonry Wall Assembly," filed Feb. 26, 2016, the content of which is herein incorporated by reference in its entirety.

BACKGROUND

U.S. Pat. No. 5,138,808, issued to Bengtson, et al., teaches a masonry block system that uses blocks formed with minimum webbing to minimize heat flow. Briefly, the patent teaches a wall system that is formed into a unitary structure using blocks. The wall also uses threaded post-tensioning rods tied to reinforcement rods in the wall footer and extending through the voids that contain polyurethane foam in the respective blocks to a top plate positioned on top of the wall.

U.S. Pat. No. 7,033,116, issued to Ward, et al., teaches a method of rammed-earth building construction wherein post-tensioning rods are anchored to a concrete footing so that the wall is post-tensioned to enhance the ability of the wall to receive lateral loading without failing in tension. The wall is then topped with a concrete bond beam and a retaining plate.

U.S. Pat. No. 6,195,955, issued to Kostopoulos, et al., teaches a method and apparatus for constructing a concrete block wall. Briefly, the patent teaches a concrete block wall constructed of concrete blocks each having one or more vertical openings. The patent includes the steps of the layering the blocks to generally align the vertical openings to initiate formation of the wall and placing reinforcement bars through the aligned openings. The wall also utilizes a connector that tightly grips each respective bar to form a frictional engagement of the connector and the bars.

U.S. Pat. No. 6,505,450 issued to Locke, et al., teaches a masonry reinforcement system. The patent teaches a reinforcement system that includes a number of tensioning rods extending from the top to the bottom of a masonry wall structure in spaced columns. In each column, several rod segments are interconnected at each floor diaphragm using a double conical connector assembly. Each type of connector assembly is embedded in a pocket formed in the masonry wall structure using a hardenable grout.

U.S. Pat. No. 6,098,357 issued to Franklin, et al., teaches a modular precast construction block system with a wall subsystem and a foundation subsystem. The wall subsystem has a number of building blocks having cavities and pre-stressed tension cables. The building blocks are aligned to form walls with vertically aligned cavities. Threaded wall bars and extension bars are threaded through the cavities. The foundation subsystem includes a variety of precast foundation members.

U.S. Pat. No. 8,225,578 issued to Ronagh, et al., teaches a method for construction of a wall using flexible interlocking mortarless building blocks. Briefly, the patent teaches a wall foundation, with foundation tendon rods, that is first constructed with a set of mechanical fastenings attached to the foundation tendon rods. A wall structure is created by vertically stacking a plurality of building blocks onto the threaded tendon rods and affixing the building blocks using the mechanical fastening. A plurality of roof connecters and rods are attached to horizontally form a network of roof rods, which interconnect the walls for building a roof.

U.S. Pat. No. 5,899,040 issued to Cerrato, et al., teaches a masonry wall system made of masonry blocks each consisting of interlocking dovetails combined with vertical and horizontal mating surfaces. The main block has two stabilizing holes through the center, and steel reinforcement rods are inserted into these stabilizing holes. The masonry components and loosely placed rods have predetermined tolerances, which permit the wall to have a fluid property. When all of the masonry components reach the peak of their tolerance, the wall locks up as a solid interconnected mass, and the force is then passed on to the stabilizing rods.

BRIEF SUMMARY

According to various implementations, a building block for a wall includes a single face shell, first and second webs, and a pier. The single face shell has an interior surface and an exterior surface, an upper surface and a lower surface, and a first end and a second end. The first and second webs each have a proximal end and a distal end. The webs extend from the interior surface of the face shell. The proximal end of each web is coupled to (e.g., integrally formed with or separately formed and attached to) the interior surface of the face shell. The pier has a proximal surface adjacent the distal ends of the first and second webs and a distal surface opposite the proximal surface and facing away from the interior surface of the face shell. The pier also includes a pier upper surface that is substantially within the same plane as the upper surface of the face shell, a pier lower surface that is substantially within the same plane as the lower surface of the face shell, a first side surface that is coupled to the distal end of the first web, and a second side surface that is coupled to a distal end of the second web. The interior surfaces of the webs, the proximal surface of the pier, and a portion of the interior surface of the face shell between the interior surfaces of the webs together define a pocket. A ledge extends from the distal surface of the pier. The ledge is spaced between the upper and lower surfaces of the pier. In some implementations, at least a portion of the ledge lies in a plane that is parallel to a plane in which at least a portion of the pier upper surface lies. In a further implementation, a plane in which at least a portion of the ledge lies is parallel to a plane in which at least a portion of the pier lower surface lies.

In addition, in some implementations, the interior surfaces of the first and second webs adjacent the proximal ends thereof and the interior surface of the single face shell define first and second grooves, respectively. The first and second grooves extend from the lower surfaces of the first and second webs, respectively, to first and second ledges, respectively, disposed within the pocket. The first and second ledges are spaced between the upper and lower surfaces of the first and second webs, respectively. And, the interior surfaces of the first and second webs adjacent the distal ends of thereof and the proximal surface of the pier define third and fourth grooves, respectively. The third and fourth grooves extend from the lower surfaces of the first and second webs, respectively, to third and fourth ledges, respectively, disposed within the pocket. The third and fourth ledges are spaced between the upper and lower surfaces of the first and second webs, respectively.

In some implementations, the upper surfaces of the first and second webs are substantially within the same plane as the upper surface of the face shell and the pier upper surface. And, in a further or alternative implementation, the lower surface of the first and second webs are substantially within the same plane as the lower surface of the single face shell and the pier lower surface.

In some implementations, a first knock-out portion of the first web is defined between the first and third grooves, the lower surface of the first web, and the first and third ledges, and a second knock-out portion of the second web is defined between the second and fourth grooves, the lower surface of the second web, and the second and fourth ledges. These knock-out portions may be removed from the building block by applying blunt force to the knock-out portions (e.g., with a hammer or mallet) to break off the knock-out portions adjacent the respective ledges and grooves. With the knock out portions removed, the proximal surface of the pier, the lower surfaces of the first and second webs, respectively, with the knock out portions removed, and the interior surface of face shell define a horizontal beam channel, which may receive a beam. In other implementations, removing the knock out portions allows access to the pocket of the building blocks on the lowermost course to remove debris before grouting the pocket and/or to inspect tensioning rods that may be installed in the pocket.

In some implementations, the interior surface of the single face shell comprises a center line that extends between the upper and lower surfaces of the single face shell and is equi-spaced between the first and second ends of the face shell. The proximal ends of the first and second webs are disposed between one of the first and second ends of the single face shell and the center line.

In some implementations, the lower surface of the pier defines a horizontally oriented groove that extends between the first side and the second side of the pier. When blocks are stacked on top of each other in horizontal courses such that the pockets in each course align with the pockets of the adjacent courses, the horizontal groove of a block in one course and the upper or lower surface of the pier of a block in an adjacent course define an opening, which may receive building services (e.g., plumbing, wiring) or horizontal reinforcements that are installed adjacent a wall of a building.

In some implementations, an exterior surface of the first web (and/or second web) defines a lifting ledge adjacent the upper surface of the first web. The lifting ledge extends outwardly from the interior and exterior surfaces of the first web in a direction parallel to a second axis. The second axis extends between the first and second ends of the single face shell. The lifting ledge allows a mason or other user to grasp the building block more easily. In some implementations, the first web is the web closest to a center of gravity of the building block.

To reduce material for the building block without compromising structural stability of the building block, the portion of the single face shell between the proximal ends of the first and second webs has a thickness as measured in a direction parallel to a first axis that is less than a thickness of a remaining portion of the single face shell, according to certain implementations. The first axis extends orthogonal to the interior surface of the face shell.

In addition, according to some implementations, the pier has a width that is less than a width defined between exterior surfaces of the first and second webs, the exterior surfaces being spaced apart and opposite from the interior surfaces of the respective web, and wherein width is measured in a direction parallel to the second axis.

In various other implementations, a masonry wall comprises a plurality of building blocks that are stacked in horizontal courses. Each building block includes a single face shell, a first and a second web, and a pier. The single face shell has an interior surface and an exterior surface, a first end and a second end, and an upper surface and a lower surface. The interior surface and exterior surface extend between the first and second ends and the upper and lower surfaces. The first web and a second web extend from the interior surface of the single face shell. Each of the first web and the second web includes a proximal end and a distal end. The proximal ends of the first and second webs are spaced inwardly from the first and second ends of the single face shell and are coupled to the interior surface of the single face shell. The pier has a proximal surface adjacent the distal ends of the first and second webs, a distal surface opposite the proximal surface and facing away from the interior surface of the single face shell, a pier upper surface that is substantially within the same plane as the upper surface of the single face shell, a pier lower surface that is substantially within the same plane at the lower surface of the single face shell, a first side surface that is coupled to the distal end of the first web, and a second side surface that is coupled to a distal end of the second web. The first and second side surfaces of the pier are spaced apart from each other and extend between the pier upper and pier lower surfaces, and the planes in which the pier upper and pier lower surfaces lie are substantially parallel to each other. Interior surfaces of the webs, the proximal surface of the pier, and a portion of the interior surface of the face shell between the interior surfaces of the first and second webs together define a pocket. In addition, a ledge extends from the distal surface of the pier in the direction away from the interior surface of the single face shell. The ledge is spaced between the upper and lower surfaces of the pier.

The plurality of building blocks of the masonry wall includes a first building block in a first horizontal course and a second building block in a second horizontal course. The first building block is stacked upon the second building block such that the webs and pockets of the first and second building blocks form a column. In addition, a channel is defined by the ledge of the first building block, the pier upper surface of the second building block, and a portion of the distal surface of the pier of the first building block between the ledge and the pier lower surface of the first building block.

In some implementations, a plane in which at least a portion of the ledge lies is substantially parallel to a plane in which at least a portion of the pier upper surface lies. In a further or alternative implementation, the plane in which at least a portion of the ledge lies is substantially parallel to a plane in which at least a portion of the pier lower surface lies.

In some implementations, the masonry wall includes furring channel framing that is disposed horizontally within the channel defined between the first and second building blocks. In other implementations, the furring channel framing is disposed diagonally within the channel defined between the first and second building blocks.

In some implementations, for each building block, the interior surfaces of the first and second webs adjacent the proximal ends thereof and the interior surface of the single face shell define first and second grooves, respectively. The first and second grooves extend from the lower surfaces of the first and second webs, respectively, to first and second interior ledges, respectively, disposed within the pocket. The first and second interior ledges are spaced between the upper and lower surfaces of the first and second webs, respectively. In addition, the interior surfaces of the first and second webs adjacent the distal ends of thereof and the proximal surface of the pier define third and fourth grooves, respectively. The third and fourth grooves extend from the lower surfaces of the first and second webs, respectively, to third and fourth interior ledges, respectively, disposed within the pocket. The third and fourth interior ledges are spaced between the upper and lower surfaces of the first and second webs, respectively.

In a further implementation, a first knock-out portion of the first web is defined between the first and third grooves, the lower surface of the first web, and the first and third ledges, and a second knock-out portion of the second web is defined between the second and fourth grooves, the lower surface of the second web, and the second and fourth ledges. When the first and second knock out portions are removed for the building blocks disposed in a particular course of the masonry wall, the lower surfaces of the webs for those blocks become closer to or continuous with the interior ledges. The proximal surfaces of the piers, the lower surfaces of the webs with the knock out portions removed, and the interior surfaces of the single face shells in the particular course together define a horizontal beam channel along the particular course. The horizontal beam channel may further be defined by the upper surfaces of the webs of the blocks of the course below.

In some implementations, the masonry wall further includes a beam that is disposed within the horizontal beam channel. The particular course may be any course along the height of a wall. For example, the beam channel may be formed in a course that is adjacent to where flooring for a second or higher story is installed or where a roof is installed. Furthermore, the particular course may be formed in more courses in areas in which seismic activity is higher to protect the wall against shear or lateral loads due to seismic activity. And, the beam channel may be formed in an uppermost course to receive a bond beam, for example.

In some implementations, the interior surface of the single face shell of each building block comprises a center line that extends between the upper and lower surfaces of the single face shell and is equi-spaced between the first and second ends. In certain implementations, the proximal ends of the first and second webs of a first set of building blocks are disposed between the first end of the single face shell and the center line, and the proximal ends of the first and second webs of a second set of building blocks are disposed between the second end of the single face shell and the center line. The blocks from the first set are laid in a first horizontal course, and blocks from the second set are laid vertically adjacent the first course in a second horizontal course, which provides a staggering effect for the ends of the blocks in each course.

In a further implementation, the pockets of building blocks in adjacent courses are aligned and stacked to form continuous columns between the adjacent courses.

In some implementations, the masonry wall may also include grout disposed within a column formed by the pockets of adjacently stacked building blocks. And, in further or alternative implementations, a vertical tensioning rod or tendon may be disposed within the column, which may be grouted in place.

In some implementations, the masonry wall may further include a wall foundation on which a lowermost horizontal course of building blocks is laid. According to some implementations, the wall foundation may include a cast-in-place footing made from, e.g., castable cement, concrete, grout, clay, fiberglass, fiber reinforced polymers, polymers, metals, pressure-wood, compacted aggregate, helical piers, pre-cast concrete or aggregate piers, a pier and beam foundation, or other moldable forming materials.

In some implementations, the bond beam may be formed from wood, wood composites, plywood, a reinforced grout bond beam, concrete, cement, iron, iron alloys, metal, nickel, steel, steel alloy, stainless steel alloys, aluminum, aluminum alloys, bronze alloys, brass, brass alloys, chromium, copper, copper alloys, polymers, plastic, reinforced polyester epoxy, fiber reinforced plastic, fiberglass, engineering plastics, Teflon®, lead, natural or synthetic rubber, steel reinforced concrete, any combination thereof, or any other suitable material. Additionally, the bond beam may include one or more openings through which each vertical reinforcement rod or tendon may extend to further provide stabilizing and support for the rods or tendons. The masonry wall may also include a cap disposed on top of the bond beam (or the uppermost layer of building blocks). The cap defines one or more openings through which a respective vertical reinforcement rod or tendon extends to stabilize and support the vertical reinforcement rod or tendon. The cap, according to some implementations, is a single elongated member defining one or more openings. In other implementations, the cap may include separate members that each define one or more openings.

In some implementations, the first and/or second web may define a fastener-receiving groove located on the exterior surface end of the web or a recess in the exterior surface of the web to receive a fastening clip. The face shell and/or the second web may also include one or more lifting ledges that can be used for grasping the building block. In addition, the building block may include one or more ridges extending from the interior surface of the face shell, the interior or exterior surfaces of one or both webs, and/or the side, distal, and/or proximal surfaces of the pier to provide additional mechanical strength and/or to provide mechanical restraining or position control for any number of items that are fitted or fixed with the masonry wall (e.g., insulation, plumbing, wiring, etc.). The interior surface of the face shell may further comprise one or more face shell lugs that each define a groove for receiving a fastener. One or more fasteners may be engaged within the grooves of the lugs to couple adjacently stacked building blocks together.

According to some implementations, the building blocks may be made from various types of materials, including for example, cement, concrete, cinder block, aggregate, clay, polymers, copolymers, metals, fiberglass, forming materials, wood, plywood, oriented strand board, particle board, cement board, engineering composite materials, bamboo, hemp, plastic, nylon, polyester, polypropylene, and polystyrene.

In some implementations, the upper surface and/or the lower surface of the face shell may define one or more horizontal grooves extending from the first end of the face shell to the second end. The horizontal grooves may receive one or more horizontal joint reinforcements between the upper surface of one building block and the lower surface of another building block stacked adjacent to each other. The one or more horizontal joint reinforcements can be made of, e.g., iron, iron alloys, metal, nickel, steel, steel alloy, stainless steel alloys, aluminum, aluminum alloys, bronze alloys, brass, brass alloys, chromium, copper, copper alloys, polymers, plastic, reinforced polyester epoxy, fiber reinforced plastic, fiberglass, fiber reinforced plastic, fiberglass, engineering plastics, Teflon®, lead, natural or synthetic rubber, or some combination thereof, and can provide mechanical and non-mechanical features to the wall. Alternatively, horizontal joint reinforcement may be installed on the mortar bed joint between adjacently stacked building blocks that do not define grooves in the upper or lower surfaces of the face shells. Apart from the horizontal grooves and joint reinforcement design, other designs for the upper and lower surfaces of the face shell include, e.g., a tongue and groove design, dovetail joints, interlocking joints, canal, corrugation, crease, crimp, cut, cutting, depression, ditch, flute, fluting, furrow, gouge, gutter, hollow, incision, notch, pucker, rabbet, rut, scallop, score, scratch, slit, trench, valley, or crenellated joints to provide interlocking capabilities between the surfaces in one or more directions.

In some implementations, the building block may include more than two webs that are coupled to the interior surface of the face shell, extend outwardly from the interior surface of the face shell, and are spaced apart from the other webs. In addition, the building block may further include (or define) one or more brick ties fastened to (or embedded in) the interior or exterior surface of the face shell or one of the webs.

Various implementations also include a method for construction (or assembly) of a wall that includes: (1) coupling one or more vertical reinforcement rods or tendons to one or more anchors embedded in a wall foundation, each of the one or more vertical reinforcement rods or tendons having a first end and a second end, and the first end of each rod being embedded or mechanically attached to a respective one of the one or more anchors, (2) disposing a first layer of one or more building blocks on the wall-foundation, and (3) disposing a second layer of one or more building blocks on the first layer such that the pockets and piers of the building blocks in the second layer align with the building blocks adjacent thereto in the first layer. In some implementations, the vertical reinforcement rods or tendons are spaced such that the one vertical reinforcement rod or tendon extends through a column defined by the pockets of adjacently stacked blocks. In other implementations, the vertical reinforcement rods or tendons are spaced such that the vertical reinforcement rod or tendon is disposed adjacent to at least one web of the building blocks.

In some implementations, the method includes creating a downward tension force in each of the vertical reinforcement rods or tendons to provide support to the wall. Creating the downward tension force may be accomplished by securing a fastener (e.g., a clip, nut, bolt, washer, screw, or other suitable fastener) over a threaded second end of each vertical reinforcement rod or tendon.

BRIEF DESCRIPTION OF THE DRAWINGS

The building block and wall assembly and methods may be understood more readily by reference to the following drawings and detailed description, which provide various implementations of the invention.

DETAILED DESCRIPTION

Figure 1:
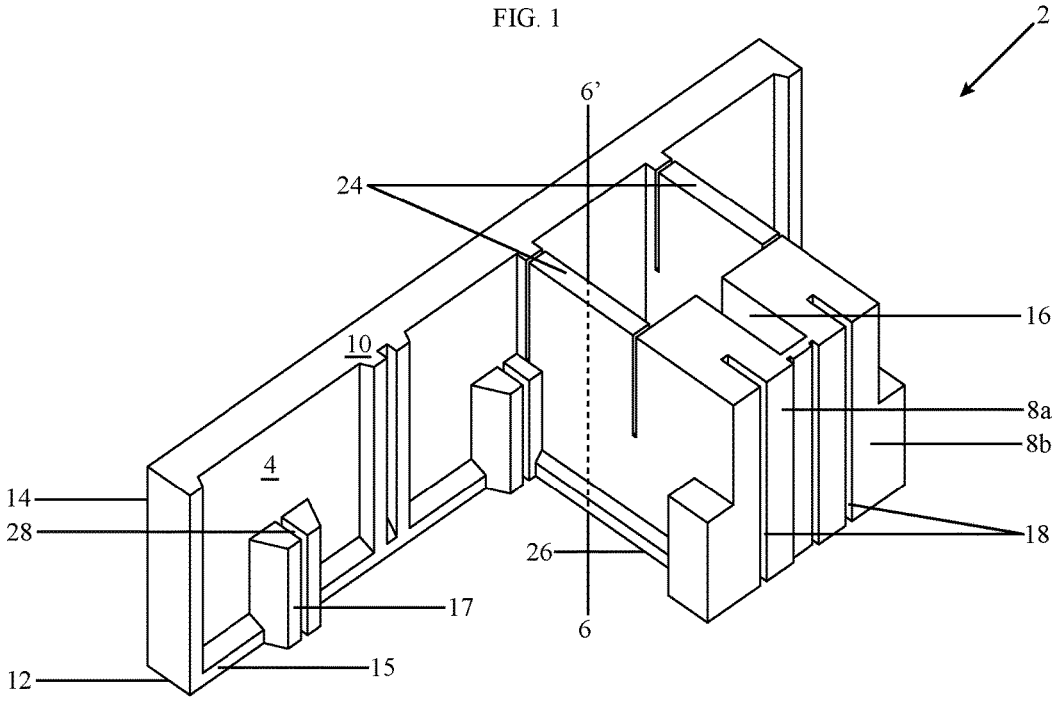
FIG. 1 is a perspective view of a building block according to one implementation.

Various implementations include a building block for assembly into a masonry wall. The building block includes a single face shell with one or more webs attached or integrally formed therewith. A face shell is the outer (or inner) sidewall of a concrete building block, in other words, the face shell can be either on the outside or the inside of the structure. In the examples shown herewith the face shell is an exterior version of the building block. A web is a portion of the building block that extends from the face shell.

The face shell and web can be made from the same material (or different materials), including but not limited to, castable cement, concrete, cinder block, clay, polymers, copolymers metals, forming materials, wood, aggregate, clay, plywood, oriented strand board, particle board, cement board, engineering composite materials, bamboo, hemp, plastic, nylon, polyester, polypropylene, polystyrene, metal, and combinations thereof. The portions of the building block that contact the foundation (or a building block above an existing building block) often include a transition that provides mechanical attachment and/or insulation, e.g., they can include a tongue and groove design, dovetail joints, or crenellated joints to provide interlocking capabilities. Horizontal joint reinforcements (e.g., pencil rods) can be placed in a groove or in a mortar joint between ungrooved blocks, which is just one example of features or methods used to provide, e.g., mechanical strength, attachment, shear stabilization, and/or insulation between one or more layers of building blocks. The horizontal joint reinforcements can be made of iron, iron alloys, metal, nickel, steel, steel alloy, stainless steel alloys, aluminum, aluminum alloys, bronze alloys, brass, brass alloys, chromium, copper, copper alloys, polymers, plastic, reinforced polyester epoxy, fiber reinforced plastic, fiberglass, engineering plastics, coated with Teflon®, lead, natural or synthetic rubber.

Constructing a wall using blocks generally requires a wall-foundation that can support the weight of the wall and/or the strain of one or more vertical reinforcement tendons. The wall-foundation can include, but is not limited to, cast-in-place footing made from castable cement, concrete, grout, clay, fiberglass, fiber reinforced polymers, polymers, metals, pressure-wood, compacted aggregate, helical piers, pre-cast concrete or aggregate piers, a pier and beam foundation, or other moldable forming materials, or it can be a pre-existing surface of, e.g., concrete, ice, rock, dirt, gravel, earth, sand, etc.

The size of each building block is not limited to a certain width, height, and depth. It is possible that an entire wall is made up of only a single sized building block. The building blocks can have a length of about 4 in, about 6 in., about 8 in., about 12 in., about 16 in., about 20 in., about 22 in., about 2 ft., about 3 ft., about 4 ft., about 5 ft., about 6 ft., about 7 ft., about 8 ft., about 9 ft., about 10 ft., about 11 ft., about 12 ft., about 13 ft., about 14 ft., about 15 ft., about 16 ft., about 17 ft., about 18 ft., about 19 ft., about 20 ft., about 21 ft., about 22 ft., about 23 ft., about 24 ft., about 25 ft., about 26 ft., about 27 ft., about 28 ft., about 29 ft., about 30 ft., about 40 ft., about 50 ft., about 60 ft. or more. Likewise with width of the face shell can be about 4 in, about 6 in., about 8 in., about 12 in., about 16 in., about 20 in., about 22 in., about 2 ft., about 3 ft., about 4 ft., about 5 ft., about 6 ft., about 7 ft., about 8 ft., about 9 ft., about 10 ft., about 11 ft., about 12 ft., about 13 ft., about 14 ft., about 15 ft., about 16 ft., about 17 ft., about 18 ft., about 19 ft., about 20 ft., about 21 ft., about 22 ft., about 23 ft., about 24 ft., about 25 ft., about 26 ft., about 27 ft., about 28 ft., about 29 ft, about 30 ft., about 40 ft., about 50 ft., about 60 ft., or more. The length is measured in a direction parallel to a transverse axis that extends orthogonal to and between the upper and lower surfaces of the face shell, and the width is measured in a direction parallel to a transverse axis that extends orthogonal to and between the first and second ends of the face shell. In certain implementations, the length of the webs can be about 4 in., about 6 in., about 8 in., about 10 in., about 12 in., about 16 in., or more. Generally, the size of the building blocks conforms to standards depending on the size of the wall and/or the load of the building, in either metric or imperial units of measure.

In one non-limiting example, a bond beam and/or cap can also placed on top of the wall. The bond beam and/or cap can include but is not limited to reinforced grout bond beam, concrete, cement, iron, iron alloys, metal, nickel, steel, steel alloy, stainless steel alloys, aluminum, aluminum alloys, bronze alloys, brass, brass alloys, chromium, copper, copper alloys, polymers, plastic, reinforced polyester epoxy, fiber reinforced plastic, fiberglass, engineering plastics, metal coated with Teflon®, lead, natural or synthetic rubber, steel reinforced concrete, or any combination thereof.

FIG. 1 depicts an individual building block 2, which includes a single face shell 14 with an interior surface 4, and two webs 8*a* and 8*b* integral with or attached to the face shell 14. A transverse axis 6-6' is shown on interior surface 4, and the webs 8*a*, 8*b* are attached to face shell 14 along the transverse axis from the top surface 10 to the bottom surface 12 of face shell 14. The building block 2 is not limited to the two webs 8*a*, 8*b*, but can also include e.g., one, two, three, four, five, or more webs. When there are two webs 8*a*, 8*b* or more, they are each separated with a gap 16. Webs 8*a* and 8*b* are also depicted as having fastener-receiving grooves 18 which extend from the top surface 24 of webs 8*a*, 8*b* to the bottom surface 26. Face shell 14 has portions that form a lifting edge 15 along the bottom of face shell 14. The presence of lifting edge 15 provides strength and a gripping feature to face shell 14, especially when face shell 14 is being lifted. Face shell 14 also has portions that form one or more face shell lugs 17 on the interior surface 4 of the face shell 14. Each face shell lug 17 also provides strength to the face shell 15. Each face shell lug 17 may be formed with portions that define a fastener receiving groove 28 for receiving a fastener (not shown in FIG. 1) for fastening the face shell 14 to another building block 2 or fastening building services (e.g., electrical, plumbing lines, etc.) to the wall.

Figure 2:
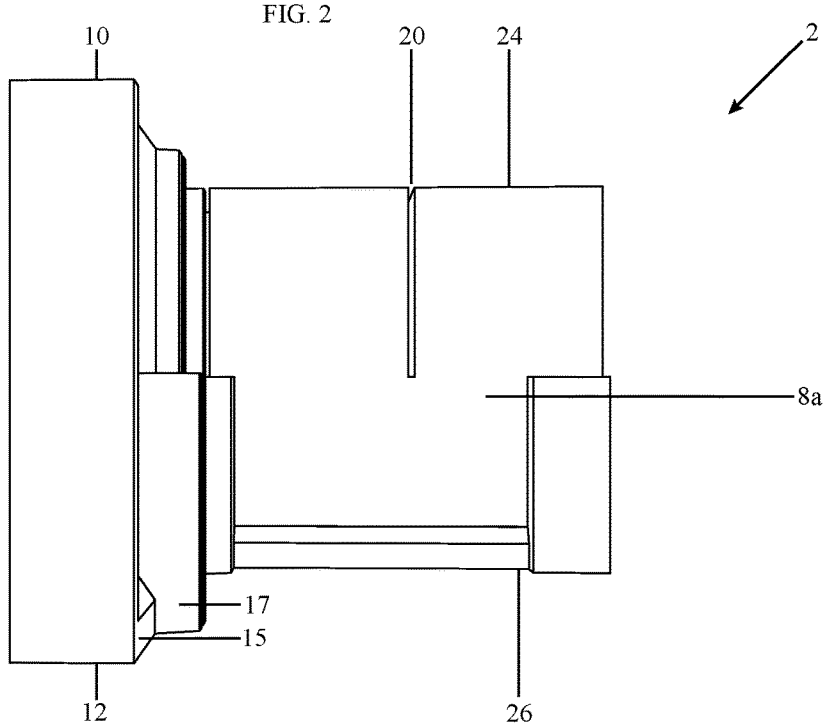
FIG. 2 is a view of the side of the building block shown in FIG. 1 depicting the first end.

FIG. 2 is a side view of building block 2 depicting an opening 20 in web 8*a*, which may be an opening knock-out that may be used e.g., as a lifting pocket for building block 2 or for inspection of rods/tendons or to pass building services. Opening 20 can exist in web 8*a*, webs 8*a* and 8*b* (not shown), or all of the webs in a multi-web arrangement, which are integral with or attached to building block 2. Opening 20 can function as an opening for e.g., horizontal reinforcements or building services such as e.g., electrical, plumbing, tubing, conduit, vacuum, fiber optic, wiring (communication, telecom, internet, Ethernet, network, IT networks), vacuum, coaxial, conduits, air vents, HVAC, ventilation, refrigeration, gas sources, lighting. Opening 20 is not limited to just being at the top surface 24 of web 8*a*, but can also be positioned along the bottom surface 26 as well, or anywhere throughout web 8*a*. Face shell 14 has portions that form a lifting edge 15 along the bottom 12 surface of face shell 14. Lifting edge 15 provides strength and a gripping feature to face shell 14. Face shell 14 also has portions that form one or more face shell lugs 17 on the interior surface 4 of the face shell 14.

Figure 3:
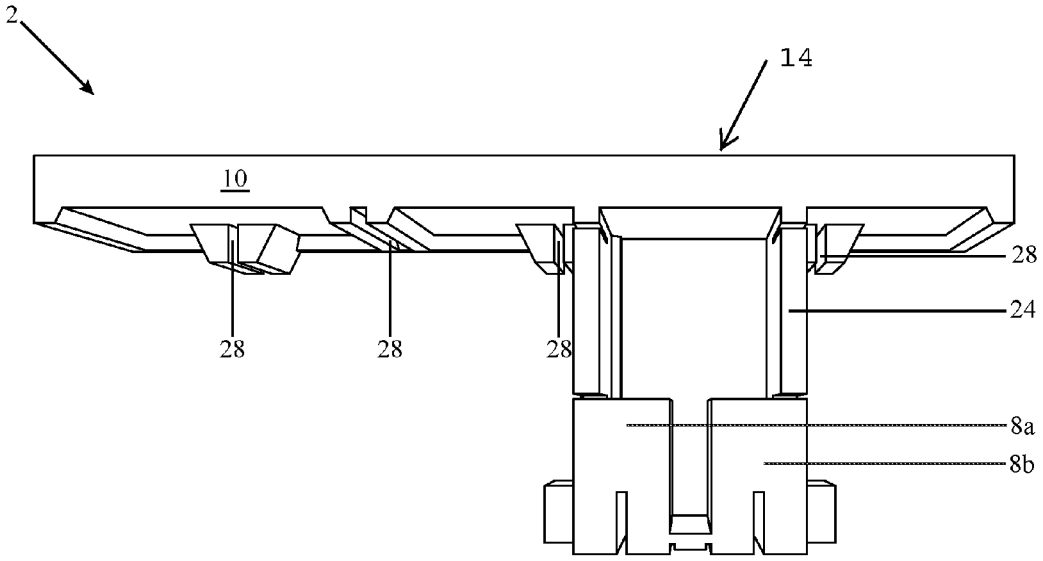
FIG. 3 is a view of the upper surface of the building block shown in FIG. 1.

FIG. 3 is a top view of building block 2 depicting top surface 10 of face shell 14 and top surface 24 of webs 8*a* and 8*b*. Top surface 10 may be formed with portions that define one, two three, four, and five or more receiving fastener grooves 28 shown in relation to the top surface 10.

Figure 4:
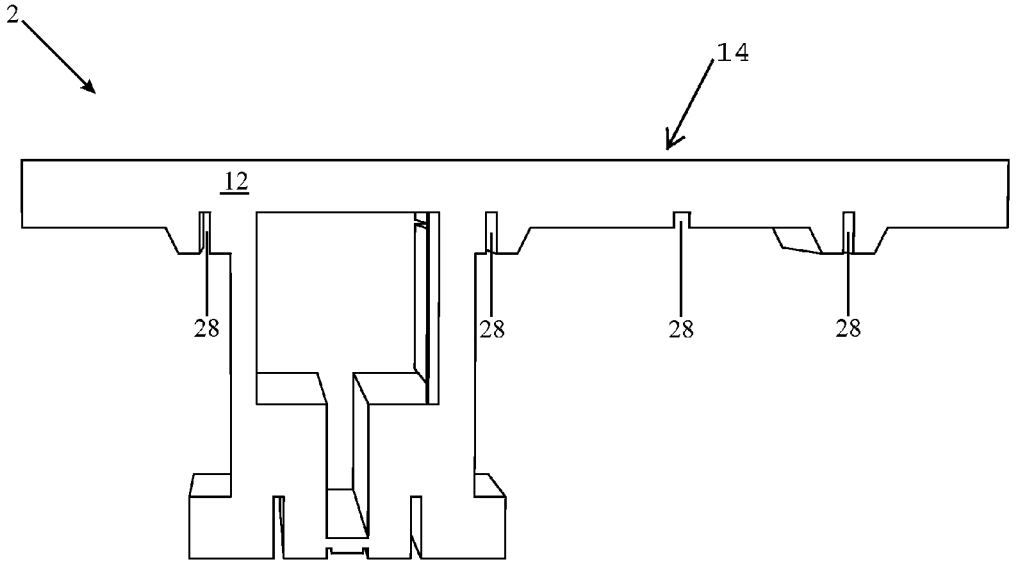
FIG. 4 is a view of the lower surface of the building block shown in FIG. 1.

FIG. 4 depicts the bottom view of building block 2 and shows the bottom surface 12 of face shell 14. FIG. 4 also shows the location of the fastener receiving grooves 28 that extend through the bottom surface 12 of face shell 14.

Figure 5:
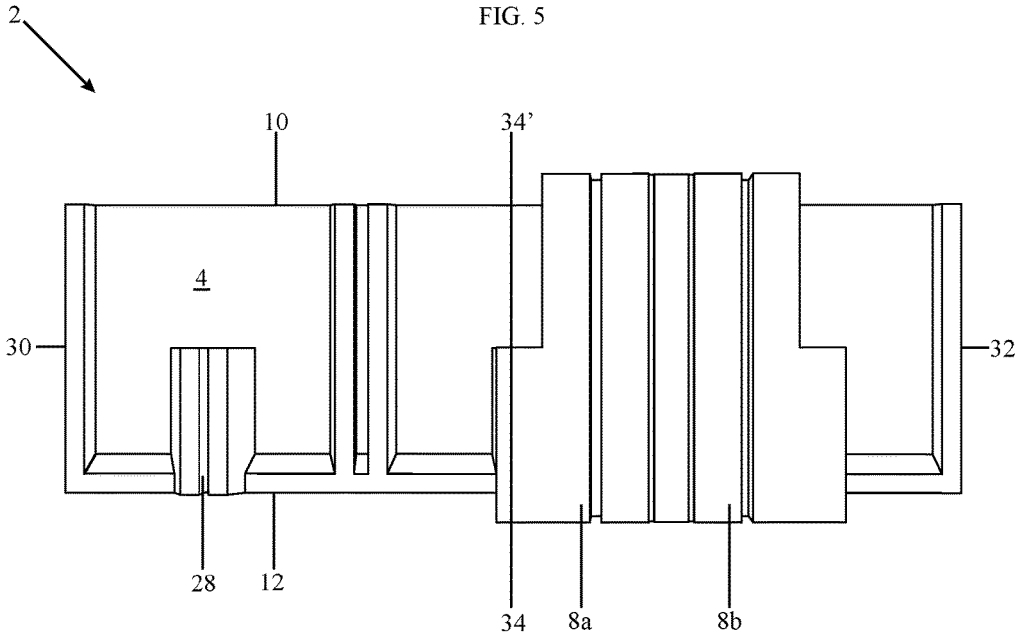
FIG. 5 is a view of the interior surface of the building block shown in FIG. 1.

FIG. 5 is a frontal view of building block 2 depicting the interior surface 4 of face shell 14. FIG. 5 shows that webs 8*a* and 8*b* are placed closer to the second end 32 of face shell 14 (see FIG. 1) and both are to the right of the middle transverse axis 34-34' of face shell 14. Face shell 14 has portions that form a lifting edge 15 and one or more face shell lugs 17 on the interior surface 4 of the face shell 14. Top surface 10 is shown along with bottom surface 12, fastener receiving grooves 28, shown with line 34-34' to show alignment and side surface 30.

Figure 6:
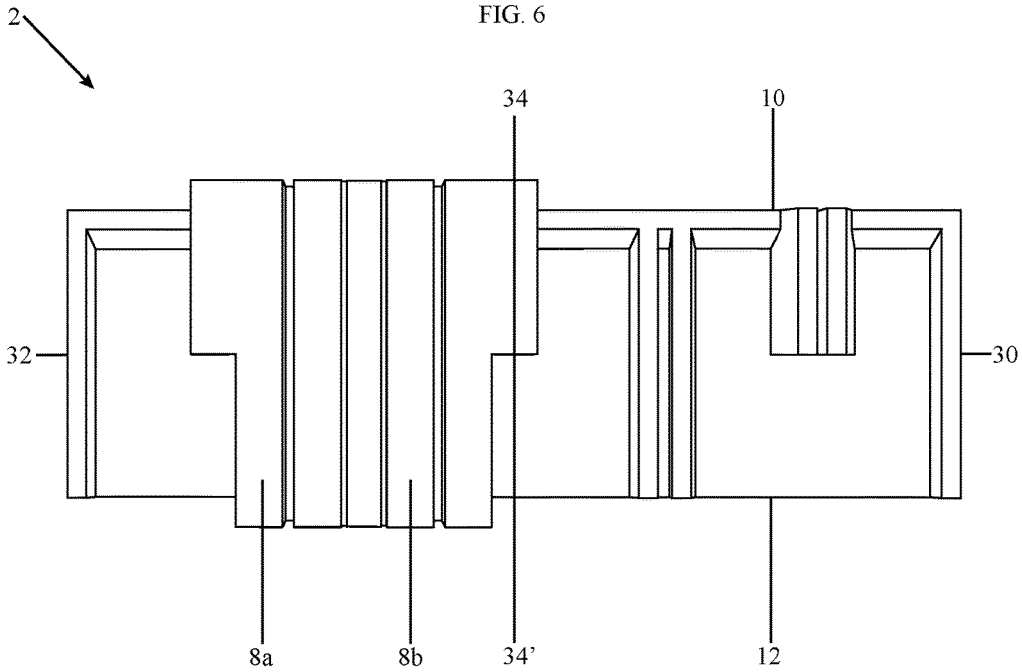
FIG. 6 is an inverted view of the building block that is shown in FIG. 5.

FIG. 6 is a frontal view of building block 2 showing an inverted view (i.e., rotated 180 degrees) of the building block 2 that is shown in FIG. 5. The building blocks 2 however are not limited to this type of placements of the one or more webs. Webs 8*a* and 8*b* are placed closer to the second end 32 of face shell 14 (see FIG. 1) and both are to the left of the middle transverse axis 34-34' of face shell 14. Top surface 10 is shown along with bottom surface 12, side surfaces 30 and 32.

Figure 7A:
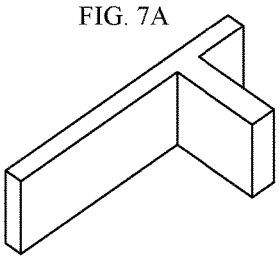
FIGS. 7A to 7O are perspective views of other implementations of building blocks incorporating various quantities and configurations of webs.
Figure 7B:
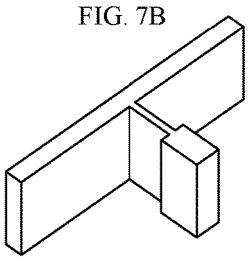
Figure 7C:
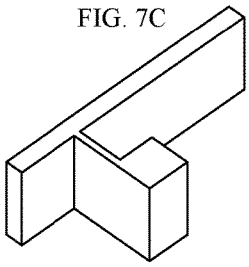
Figure 7D:
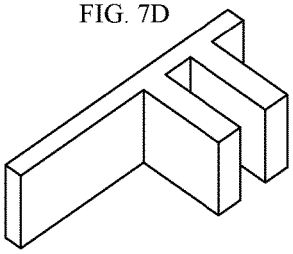
Figure 7E:
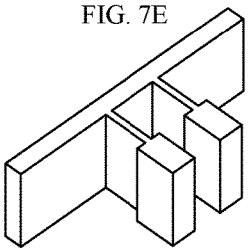
Figure 7F:
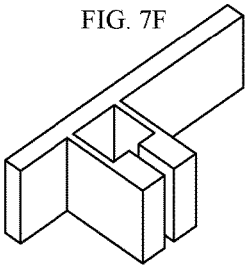
Figure 7G:
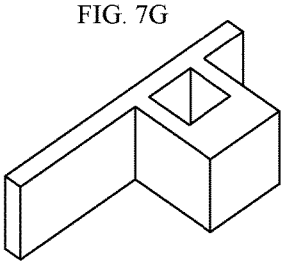
Figure 7H:
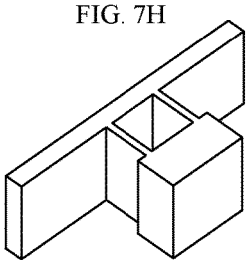
Figure 7I:
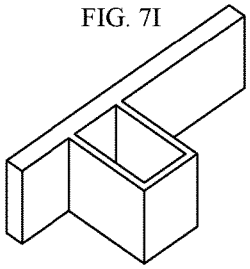
Figure 7J:
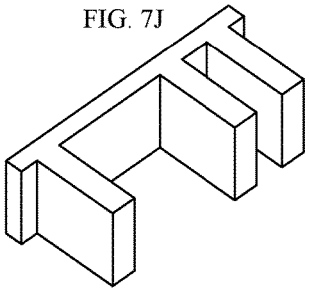
Figure 7K:
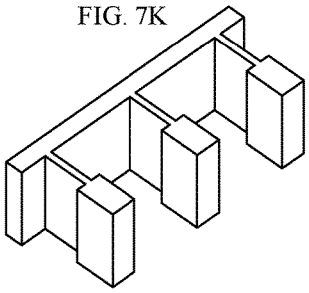
Figure 7L:
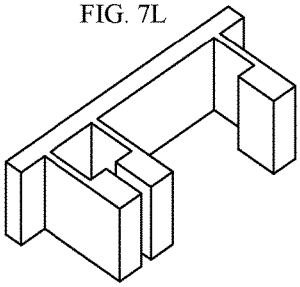
Figure 7M:
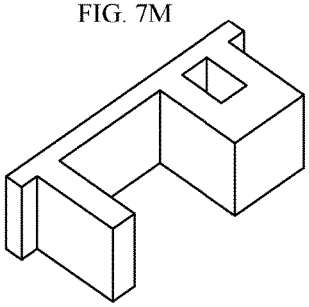
Figure 7N:
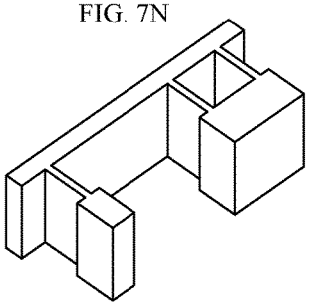
Figure 7O:
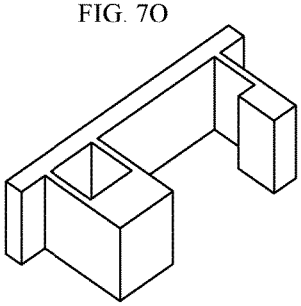

FIGS. 7A to 7O are perspective views of other non-limiting implementations of the building block that incorporate various quantities and configurations of webs and while shown with specific configurations, the skilled artisan will recognized that whether the webs are right-of-center, in the mid-point or left-of-center, these can be configured in the opposite manner and can include any variants of the same. The various figures show the building block 2 with: a single web to the right-of-center (7A), a single web in the center with a center-aligned enlarged web (7B), a left-of-center web that is enlarged but not centered (7C), a double web configuration with both webs right-of-center (7D), a double web with each web adjacent the centerline of the building block and having an enlarged portion (7E), a double web configuration with both webs left-of-center and having an enlarged portion that extends into the opening between the webs (7F), a double web configuration where the webs are attached to each other and are right-of-center (7G), a centered double web configuration in which the webs are also attached and further comprise additional material outside the opening between the webs (7H), a double web configuration that is left-of-center and is attached without additional material (7I), a triple web configuration with two webs right-of-center and one web left-of-center (7J), a triple web configuration with a web in the center, the right-of- and left-of-center with additional material at the end (7K), a triple web configuration shown with two webs left-of-center and one web right of center with additional material (7L), a triple web configuration with a single web left-of-center and two connected webs right-of-center (7M), a triple web configuration with a single web left-of-center and two connected webs right-of-center both with additional material (7N), and a triple web configuration with a double web left-of-center connected webs and a single right-of-center web (7O). The skilled artisan will recognize that the building block can include more than three webs, that the exemplary building blocks shown are not limiting but rather show various optional configurations which can be mixed and matched to produce variants on either side, middle, or both.

Figure 8:
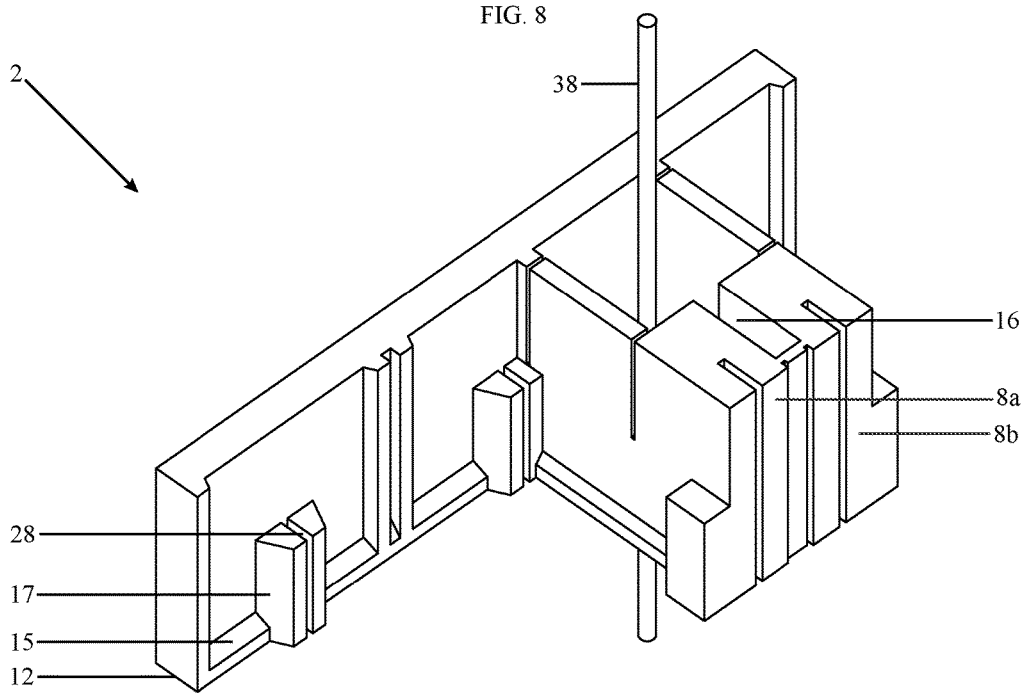
FIG. 8 shows a vertical reinforcement tendon placement adjacent to the webs, according to one implementation.

FIG. 8 shows the placement of a vertical reinforcement tendon 38 in gap 16 between webs 8*a* and 8*b* of building block 2. Face shell 14 (see FIG. 1) has portions that form a lifting edge 15 along the bottom 12 surface of face shell 14. Lifting edge 15 provides strength and a gripping feature to face shell 14. Face shell 14 also has portions that form one or more face shell lugs 17 on the interior surface 4 of the face shell 14. Also shown are bottom surface 12 and fastener receiving grooves 28.

Figure 9:
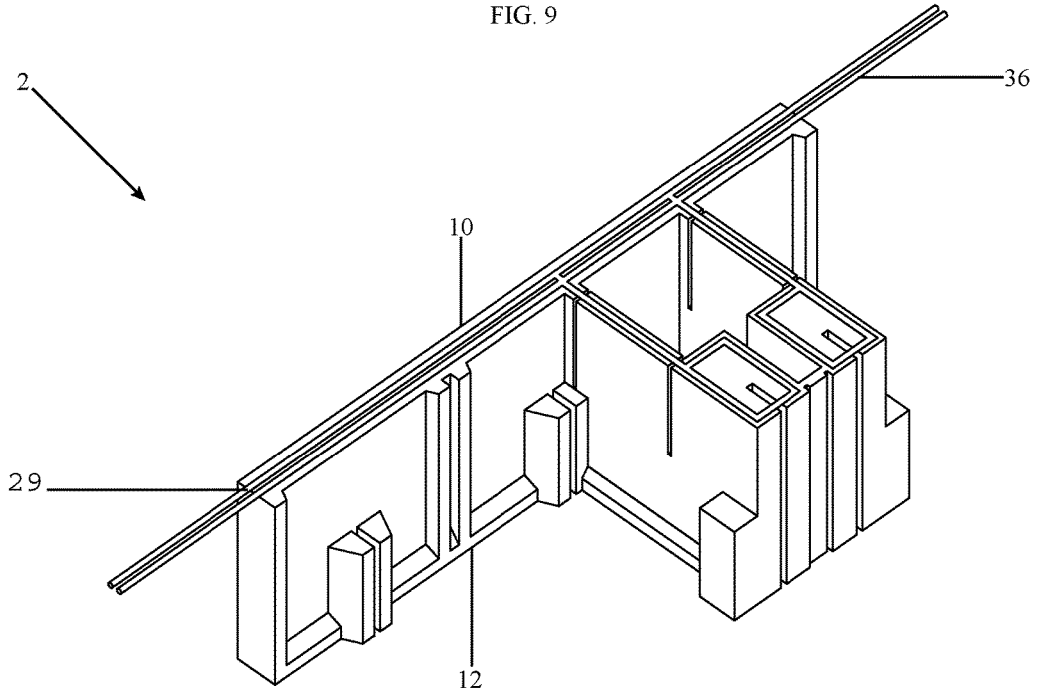
FIG. 9 shows horizontal joint reinforcements placed in a horizontal mortar bed joint between building blocks, according to one implementation.

FIG. 9 shows the placement of horizontal joint reinforcements 36 on the face shell and webs of building block 2. The horizontal joint reinforcements 36 sit between the top surface 10 and bottom surface 12 of different layers of building blocks 2, which can be inserted into grooves 29. This is only one example of the construction design between the top surface 10 and bottom surface 12 of different building blocks 2. The design serves to provide both mechanical features such as friction and reducing shear movement between the surfaces, and non-mechanical features such as insulation for the wall.

Figure 10:
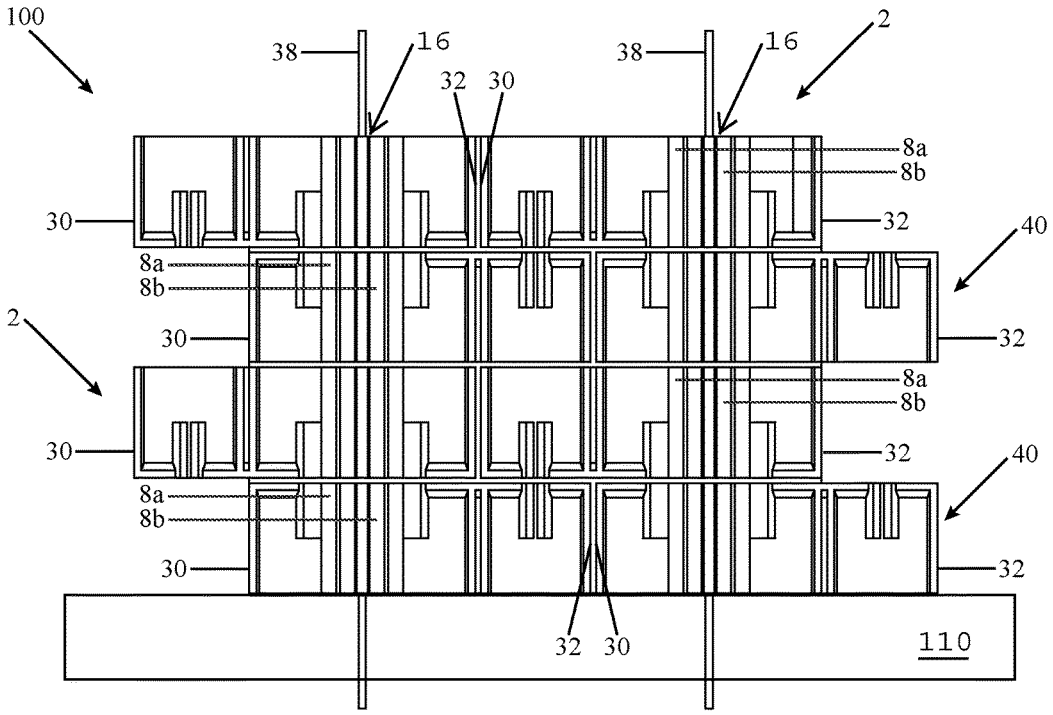
FIGS. 10 to 11 are illustrations of a partially completed wall constructed in accordance with a method according to one implementation.
Figure 11:
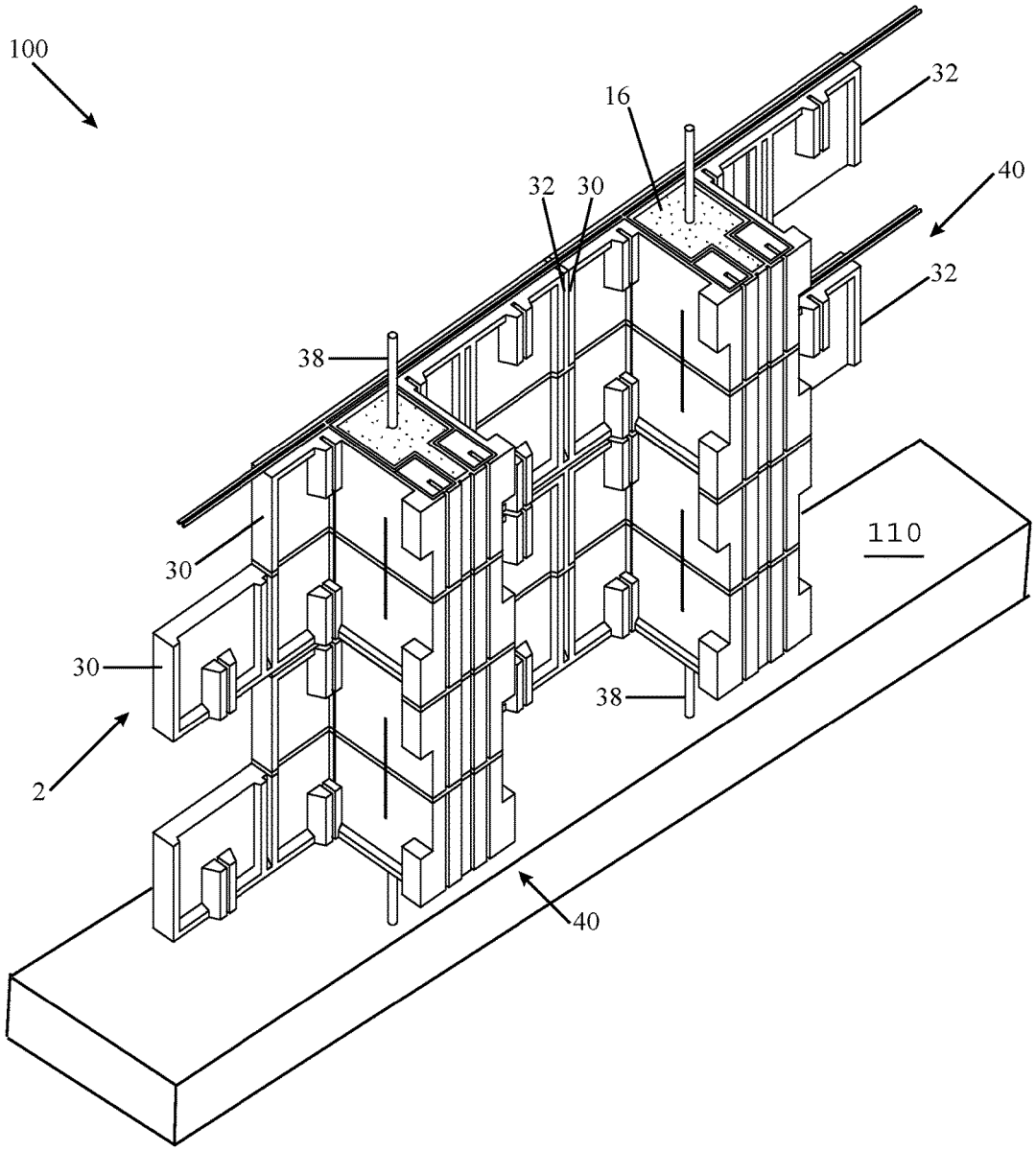

As shown in FIGS. 10 and 11, wall 100 is constructed by first positioning one or more vertical reinforcement rods or tendons 38 in a wall-foundation 110, followed by the laying of a first layer of one or more building blocks 2 on the wall-foundation 110 such that the one or more vertical reinforcement rods or tendons 38 are adjacent to webs 8*a* and 8*b* and are in gap 16. The skilled artisan will recognize that the rods or tendons 38 can be a single piece or multiple pieces that are fastened together and tightened and may be pre-inserted into the foundation prior to installation of the building blocks, or may even be added during or even after installation of some of or the entire wall. The wall construction further includes laying one or more subsequent additional layers of building blocks 40 such that the webs of the subsequent layer is aligned and flush with the webs 8*a*, 8*b* of the previous layers of building block 2. Additionally, the one or more vertical reinforcement rods or tendons 38 also run through or are adjacent to the webs 8*a*, 8*b* of the subsequent layer of building block 2. Wall 100 is shown alternating building block 2 in an upright and inverted orientation between layers. With the aligning of the webs 8*a*, 8*b*, the different building blocks causes the first end 30 and second end 32 of the subsequent layers to be staggered compared to the first end 30 and second end 32 of the previous layers. FIG. 11 is an isometric view of wall 100 showing the alignment of the webs 8*a*, 8*b* that allows the continued placement of the vertical reinforcement rods or tendons 38 to be adjacent to the webs 8*a*, 8*b*, or to potentially go through them and are depicted with a filler, concrete or equivalent in gap 16.

Figure 12:
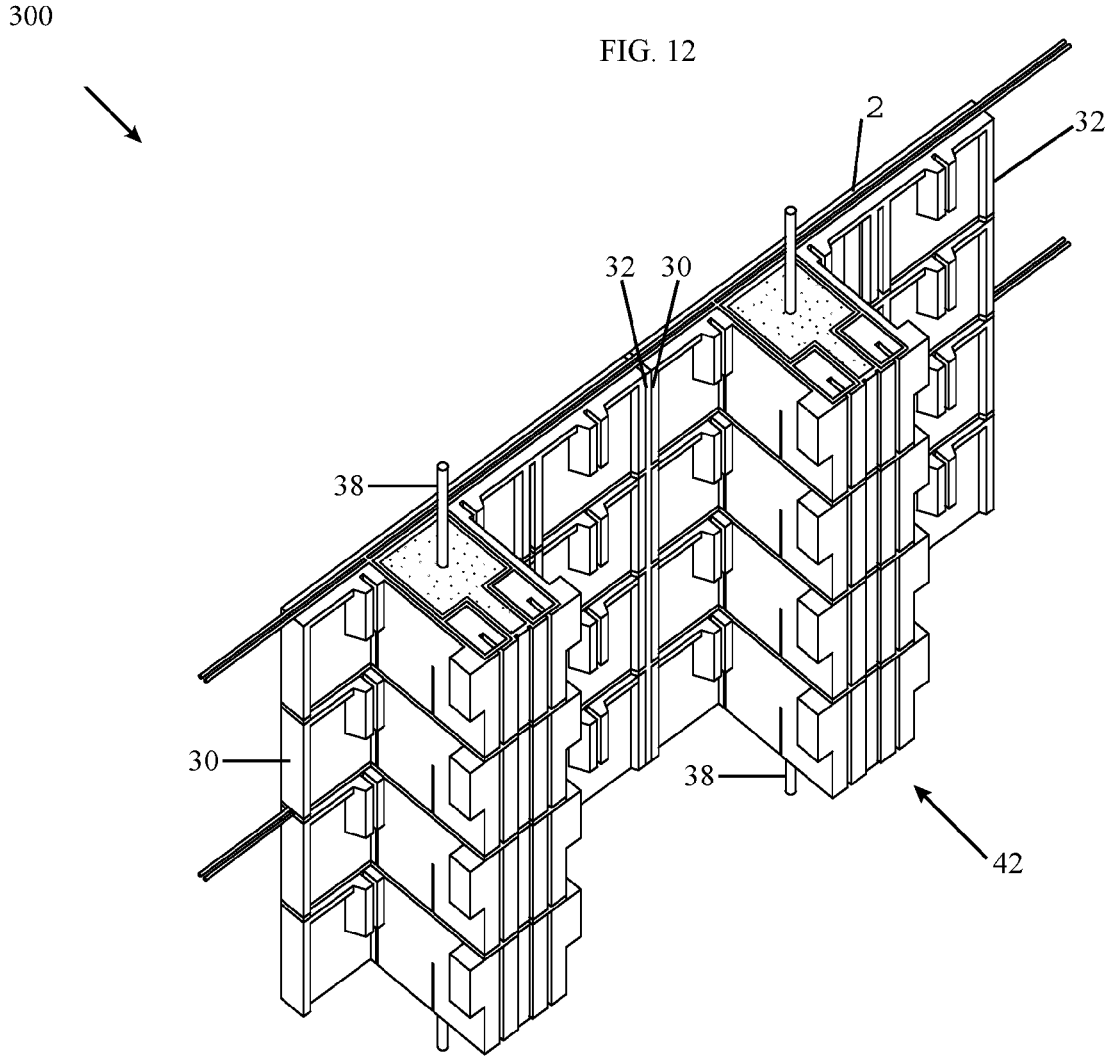
FIG. 12 shows another partially completed wall constructed in accordance with a method according to another implementation.

FIG. 12 shows wall 300 constructed with building block 2 with all blocks in an inverted orientation as shown in wall 100 of FIGS. 10 and 11. The first and second ends 30 and 32 in wall 300 are not staggered, but instead are aligned for building blocks 42. The webs in wall 300 are also aligned and flush for the proper placement of vertical reinforcement rods or tendons 38. Placement of all blocks in an upright orientation is another implementation and creates a similar condition.

After the final layer of the building block is laid and the optional bond beam and cap placed, a downward tension is created in the vertical reinforcement tendon to enhance the ability of the wall to receive lateral loading without failing in tension. The creating of the downward tension in the vertical reinforcement tendon can be but is not limited to being accomplished with a fastener such as a clip, nut, bolt, washer, or screw that secures over a threaded second end of each vertical reinforcement tendon. Additional methods include but not limited to physically deforming the vertical reinforcement tendon to also create the downward tension and stabilize the vertical reinforcement tendon.

The single face shell provides access to vertical reinforcement tendon members for inspection, maintenance, and replacement, as well as access to wall interior during or after construction for installation of concealed building services, damp proofing, and insulation. Allowing access to wall interior results in decreases in construction time and increases in construction efficiency.

The building block according to various implementations of the present invention provides several distinct advantages: including but not limited to: singlet sided single face shell: access to interior of wall after erection, which: reduces trade scheduling dependencies; allows installation of: vertical reinforcing/post-tensioning tendon, damp proofing, insulation, building services (elec., plumbing, low-voltage, etc.), and allows inspection of building services (elec., plumbing, low-voltage, etc.) after the wall is erected.

The building block according to various implementations also provides an open system, which allows for: modular coursing with standard block; works with installation of conventional non-proprietary (e.g., inexpensive) insulation systems; allows typical or conventional installation for electric, or plumbing), or low-voltage systems; and supports typical interior/exterior finishes other than masonry if desired.

Another advantage of the building block according to various implementations is that is uses less material per square foot of wall area (efficient with material and labor) and more wall area per block (in particular when used as a one-handed block for installation). Another advantage is that the building blocks can be nested together for shipping, pressing and curing, which allows for more efficient manufacturing and palletizing, shipping, and/or staging.

Additional advantages of the building block according to various implementations includes that the building blocks are reversible (integral masonry surface (e.g., the face shell) can be inside or out) allowing an earlier building dry-in for accelerated construction schedules. Other advantages include: reinforcing options/flexibility, such as: conventional grouted rebar; and no-grout post-tensioned reinforcing. The building blocks allow for true back dam flashing in single wythe construction, and it also allows industrial buildings to later be upgraded to more finished uses without supplemental framing.

Figure 13A:
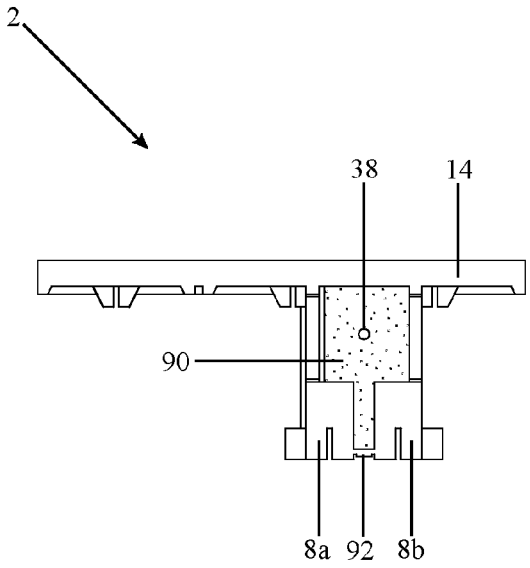
FIGS. 13A and 13B show top views of building blocks according to various implementations.
Figure 13B:
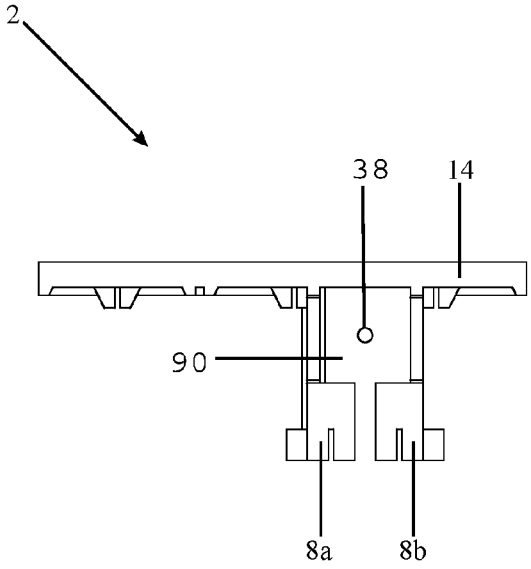

FIGS. 13A and 13B include two top views of a building block according to one implementation showing two variations for providing mechanical strength to the wall, before, during or after installation. In FIG. 13A, a building block 2, is shown with face shell 14 and webs 8*a* and 8*b*. A vertical reinforcement tendon 38 is shown within a grout 90, which is held in place while hardening using an integral knock-out 92. In FIG. 13B, a building block 2, is shown with face shell 14 and webs 8*a* and 8*b*. A vertical reinforcement tendon 38, but in this version the post-tensioning of the rod provides all the support without the addition of a grout 90 or other packing materials in the space between webs 8*a* and 8*b*.

Figure 14A:
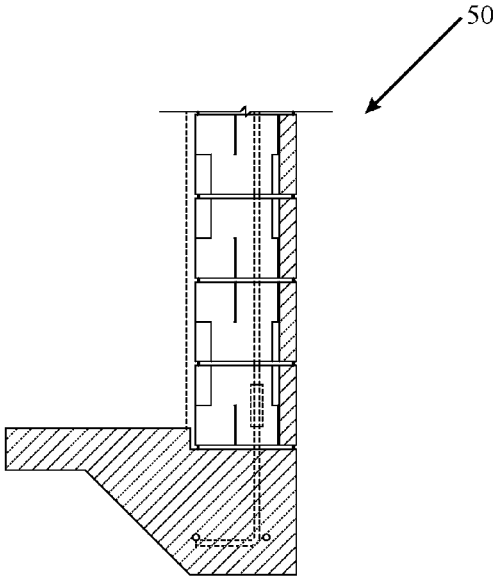
FIGS. 14A to 14D show side views of options for installation of the wall assembly on various types of foundations.
Figure 14B:
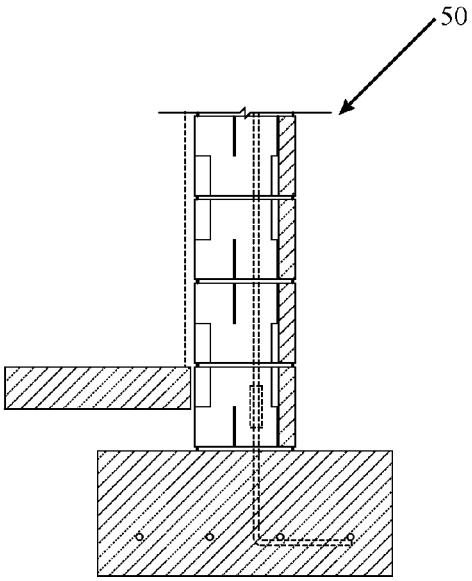
Figure 14C:
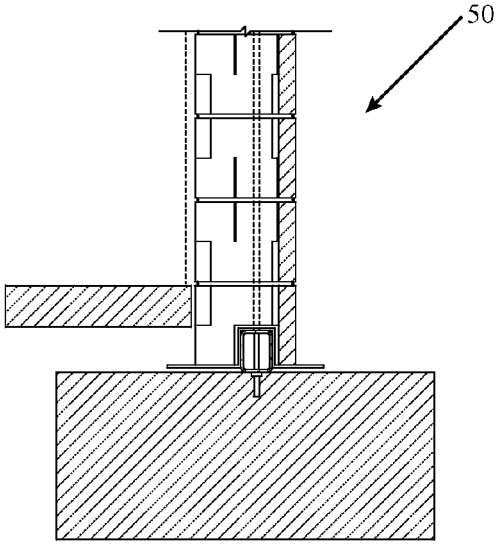
Figure 14D:
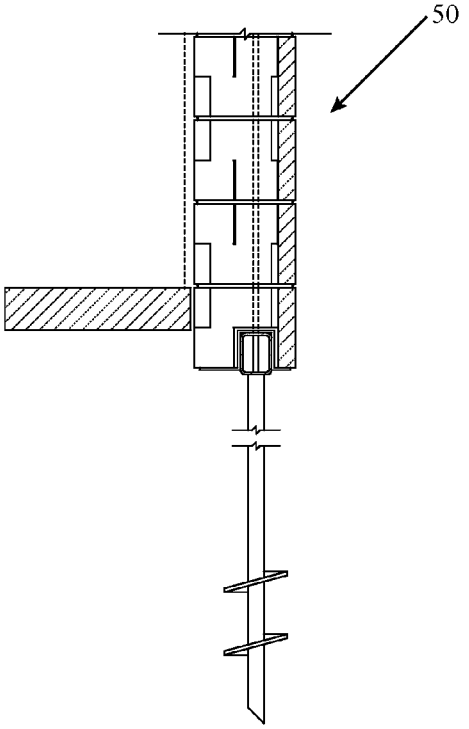

FIGS. 14A, 14B, 14C, and 14D show various side views of wall assemblies positioned on various types of foundations. FIG. 14A shows a vertical reinforcement in which the wall assembly 50 is shown over a footing integrated with a slab on-grade edge. In FIG. 14B, the wall assembly 50 is shown over a continuous linear cast-in-place 'strip' foundation. In FIG. 14C, the wall assembly 50 is shown over a compacted aggregate with steel tube and spreader plates. FIG. 14D shows the wall assembly 50 is shown over helical piers with steel tube and plates.

Figure 15A:
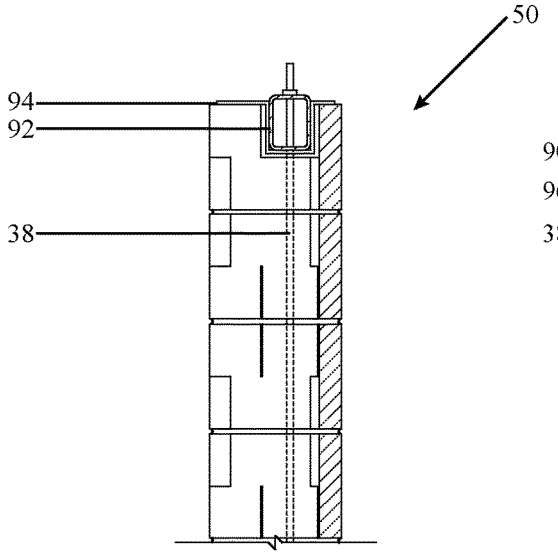
FIGS. 15A to 15C show side views of a wall assembly with three variations for the top of the wall.
Figure 15B:
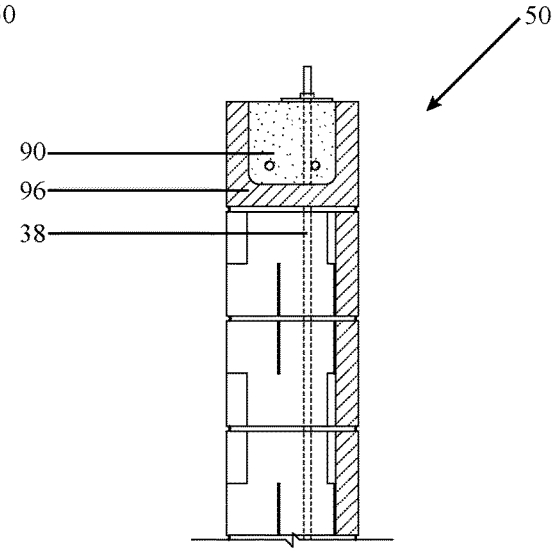
Figure 15C:
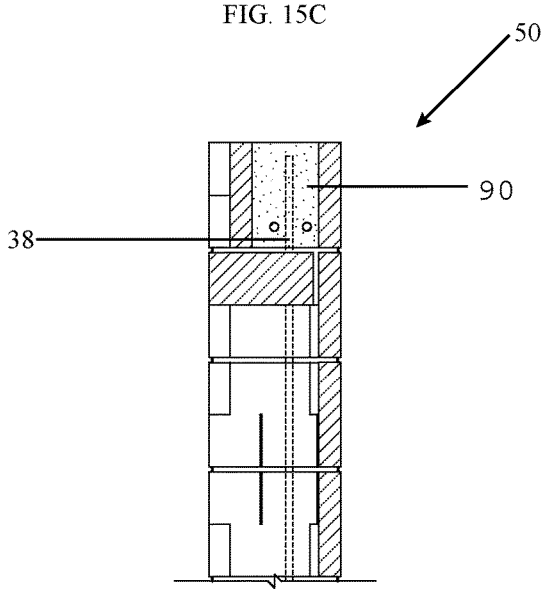

FIGS. 15A, 15B, and 15C show three variants for mechanical support at the top of wall. FIG. 15A shows the use of a tube 92 and spreader plates 94 on wall assembly 50, in relation to the vertical reinforcement tendon 38. In the implementation shown in FIG. 15B, grout 90 and longitudinal reinforcing is used within a beam 96, shown on wall assembly 50 also, in relation to the vertical reinforcement tendon 38. In FIG. 15C, grout 90 and longitudinal reinforcing is used within a continuous cavity formed by blocks supported by lugs and ridges of building blocks.

Figure 16A:
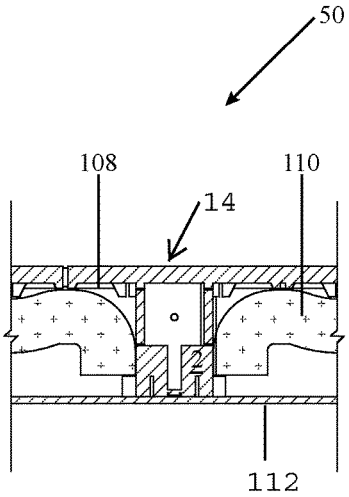
FIGS. 16A, 16B, and 16C show implementations of wall assemblies in which the face shell serves as the outside wall.
Figure 16B:
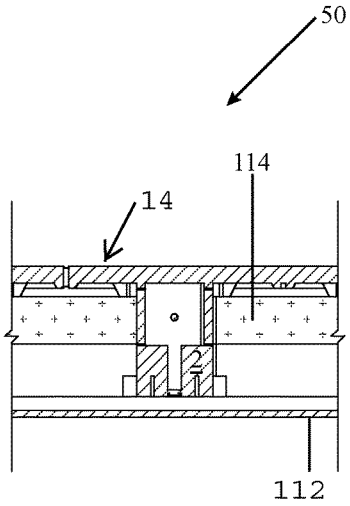
Figure 16C:
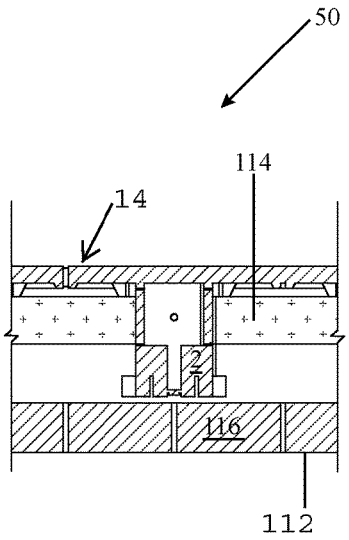

FIGS. 16A, 16B, and 16C show examples of an implementation in which, once the wall has been assembled it can include various finishes using a configuration in which the face shell 14 serves as the exterior wall surface of building block 2. The face shell 14 serves as the exterior wall surface, which can be, e.g., sealed, painted directly, and/or can be pre-painted. The wall assembly 50 is shown with an internal damp-proofing 108, batt insulation 110 (also shown for illustration purposes as rigid insulation 114), which can be inserted with friction based on the size of the building block and the insulation, or attached with ties, and the interior wall 112. Also for purposes of illustration the interior wall can be a wall-board, e.g., sheetrock, concrete board, fiberglass, or wood (with or without a pre-existing moisture barrier), and/or brick 116.

Figure 16D:
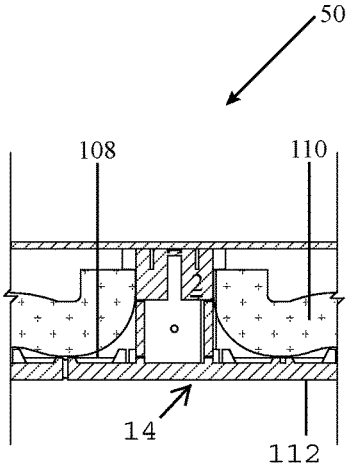
FIGS. 16D, 16E and 16F show implementations of wall assemblies in which the face shell serves as the inside wall.
Figure 16E:
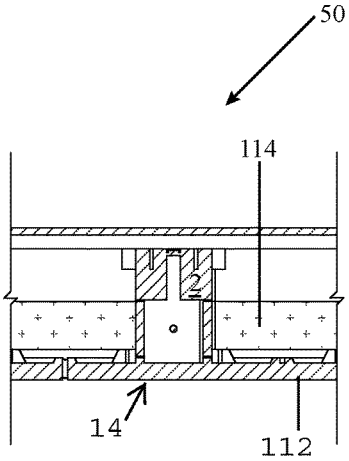
Figure 16F:
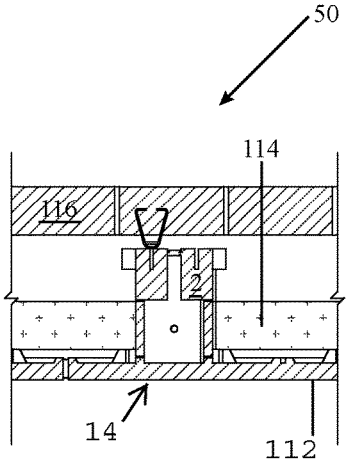

FIGS. 16D, 16E and 16F show examples of an implementation in which the wall, once assembled, has a face shell 14 serves as the interior wall surface. The face shell 14 serves as the interior wall surface, which can be, e.g., sealed, painted directly, and/or can be pre-painted. The wall assembly 50 is shown with an internal damp-proofing 108, batt insulation 110 (also shown for illustration purposes as rigid insulation 114), which can be inserted with friction based on the size of the building block and the insulation, or attached with ties, and the interior wall 112. Also for purposes of illustration the exterior wall can be a wall-board, e.g., concrete board, fiberglass, metal, or wood (without or without a pre-existing moisture barrier), and/or brick 116.

Figure 17A:
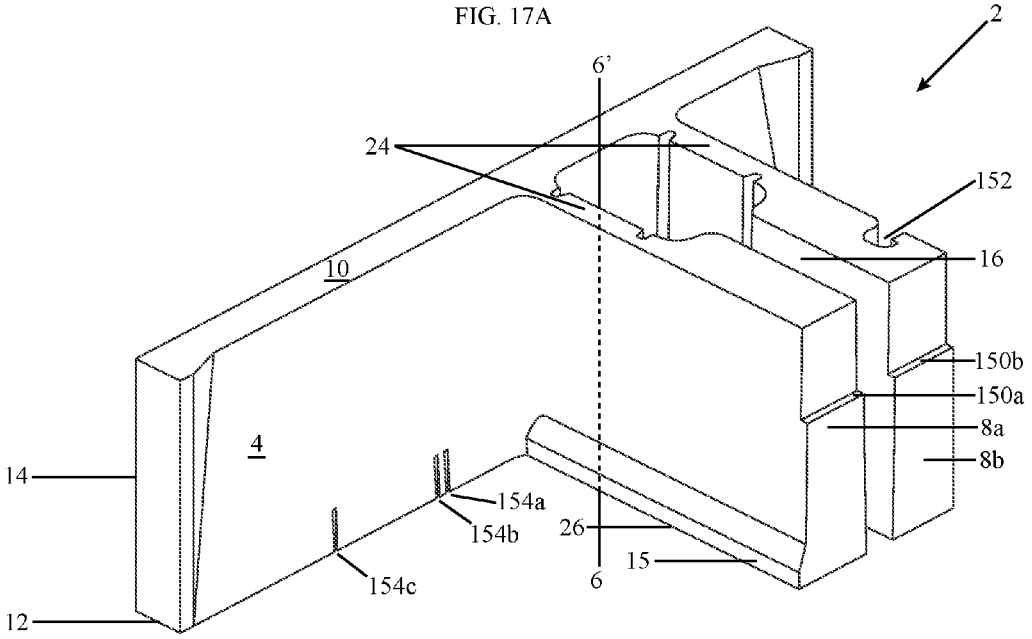
FIGS. 17A to 17D show implementations of wall assemblies in which a clip pocket and ledge for attachment of interior finish framing is shown, and index marks are included to provide locations for cuts used for blocks in corners and/or window jambs.
Figure 17B:
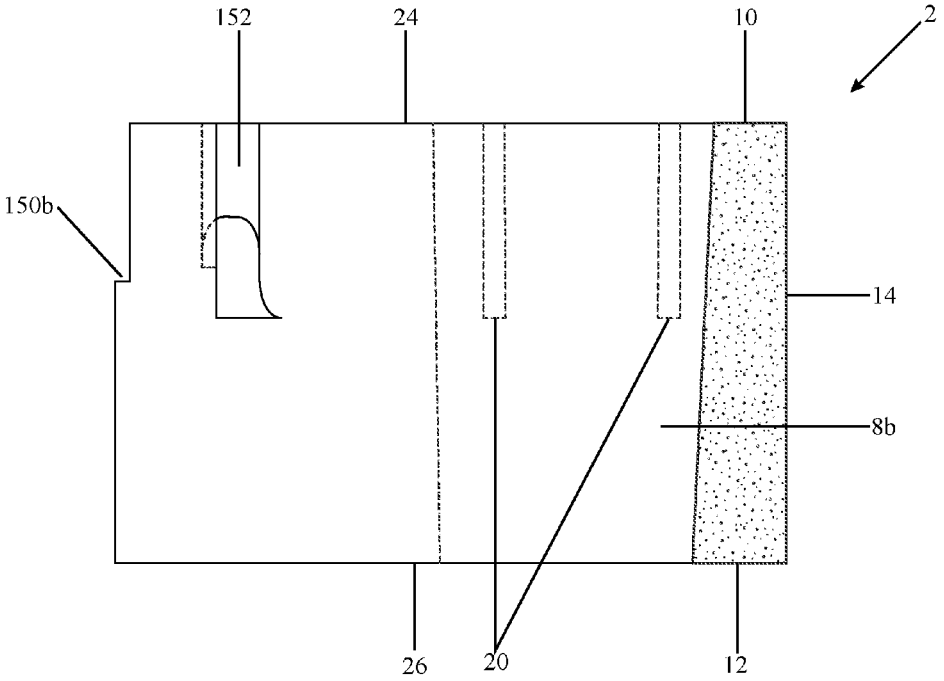
Figure 17C:
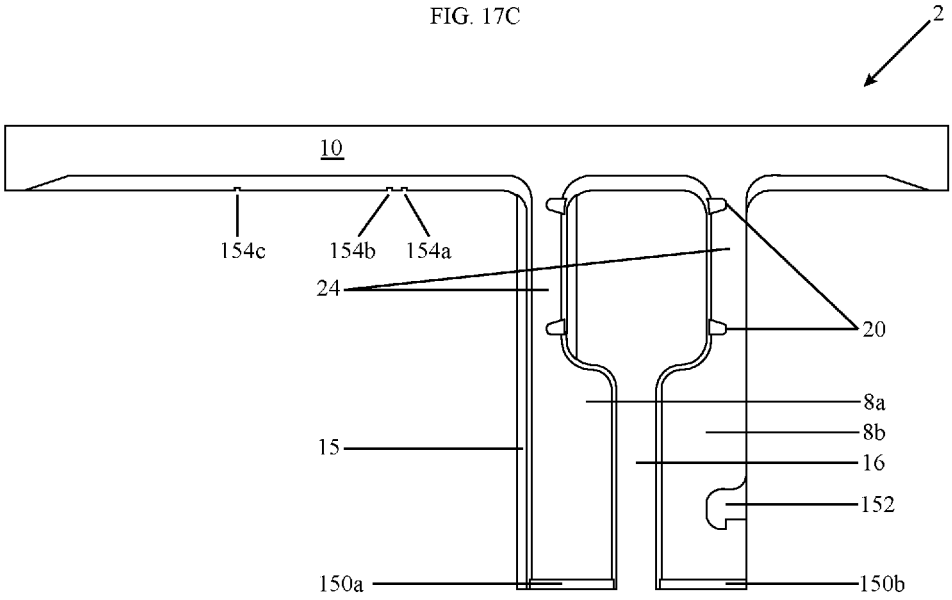
Figure 17D:
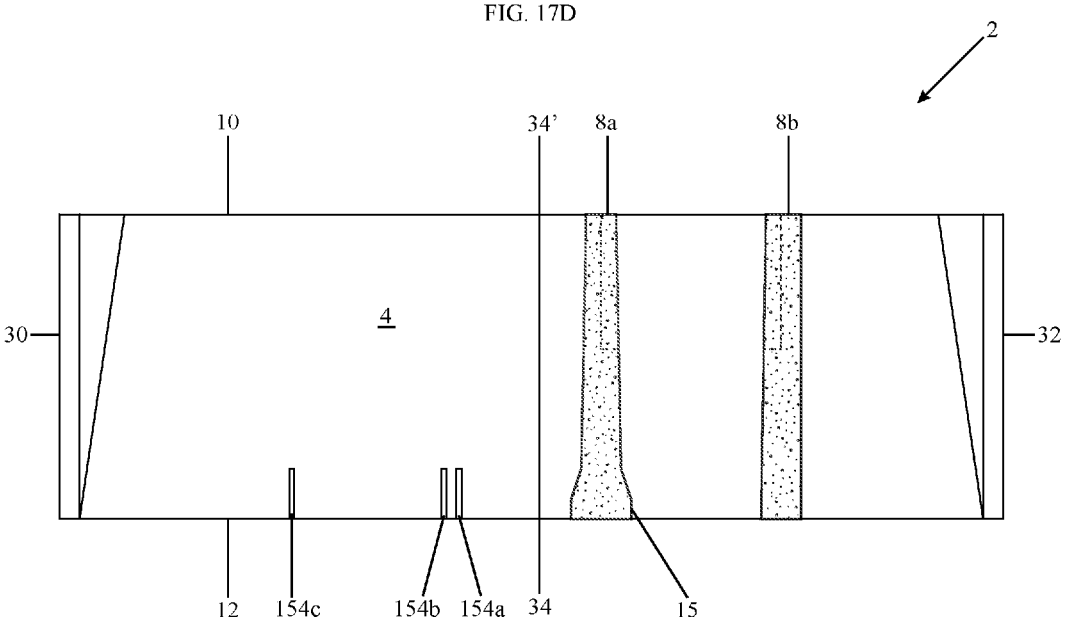
Figure 18:
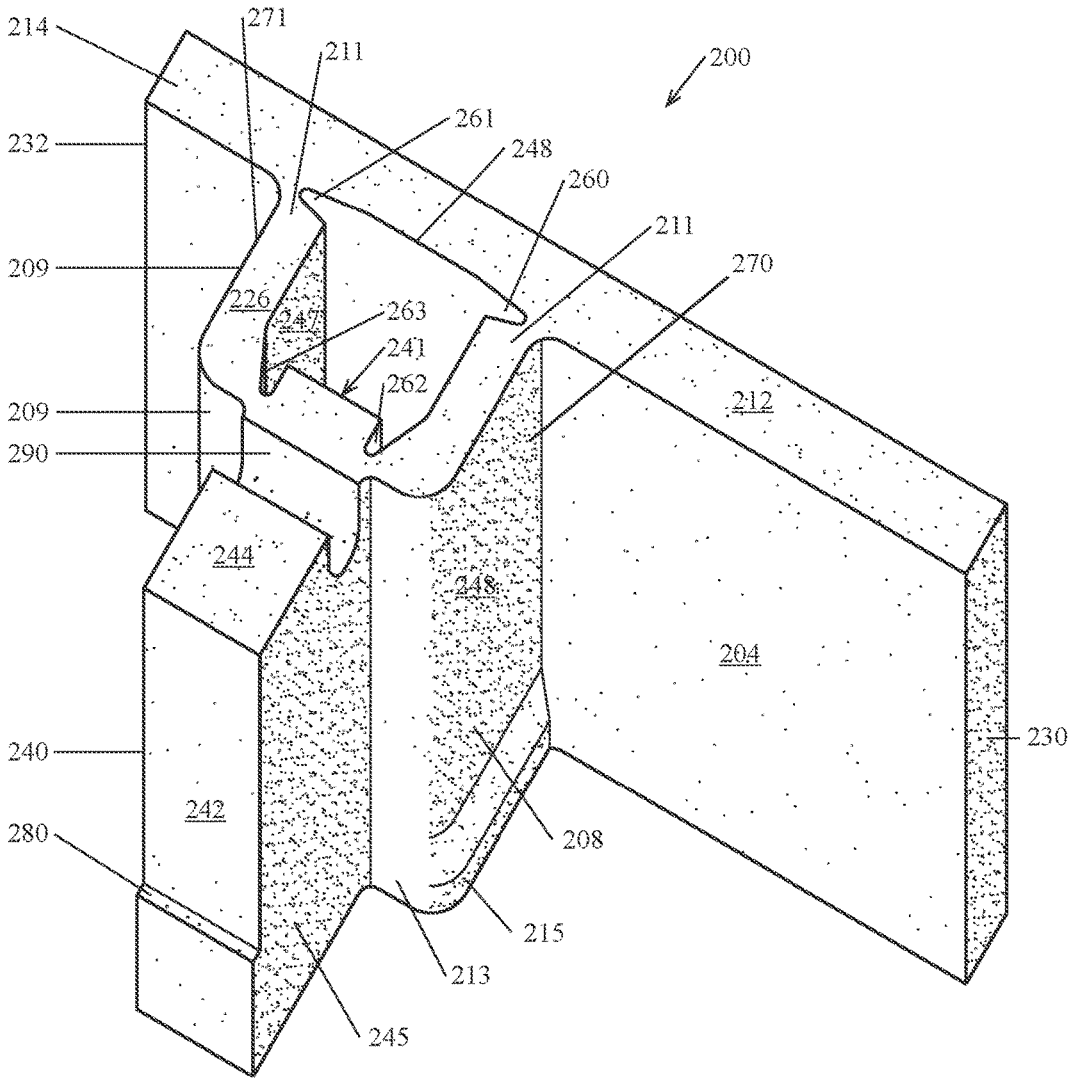
FIG. 18 illustrates a perspective view of a building block according to another implementation.

FIG. 17A is an isometric view, FIG. 17B a side view, FIG. 17C is a top-view and FIG. 17D is another side view of an individual building block 2, which includes a single face shell 14 with an interior surface 4, and two webs 8*a* and 8*b* integral with or attached to the face shell 14. As depicted in FIG. 17A, this implementation of the individual building block 2 further includes notches 150*a*, 150*b* at the end of the two webs 8*a* and 8*b* opposite the face shell 14 that can be used, e.g., as a ledge for a HAT or furring channel framing. Also shown in FIG. 17A is a channel 152, designed to receive fasteners, e.g., to receive a tension clip for the attachment of interior finish framing (not shown). In addition, another optional feature shown in this implementation of the individual building block 2 are cut index marks 154*a*, 154*b*, and 154*c*. The cut index marks 154*a*, 154*b*, and 154*c* are spaced to provide convenient marks for cutting the individual building block 2 to form corners, door or window jambs. The face shell 14 is depicted in this implementation having a reduced concrete volume by tapering the interior surface 4 of the face shell 14, until either end of the face shell is reached, wherein the face shell 14 is thickened to a uniform thickness, e.g., 1⅝ inches. The edges of the two webs 8*a* and 8*b* are shown having rounded internal edges to facilitate manufacturing of the blocks. The two webs 8*a* and 8*b* are shown forming an opening or gap 16 between the webs 8*a* and 8*b*.

FIGS. 18-27 illustrate a building block 200 for a masonry wall according to another implementation. According to various implementations, the building block 200 includes a single face shell 214, first web 208, second web 209, and a compression pier 240. The single face shell 214 has an interior surface 204 and an exterior surface 205, an upper surface 210 and a lower surface 212, and a first end 230 and a second end 232.

The first 208 and second webs 209 each have a proximal end 211 and a distal end 213. The webs 208, 209 extend from the interior surface 204 of the face shell 214. The proximal end 211 of each web 208, 209 is coupled to (e.g., integrally formed with or separately formed and attached to) the interior surface 204 of the face shell 214. The webs 208, 209 shown in FIG. 18 extend substantially orthogonal to the interior surface 204 of the face shell 214. However, in other implementations (not shown), the webs 208, 209 may extend at an angle greater than or less than 90° from the interior surface 204.

The compression pier 240 has a proximal surface 241 adjacent the distal ends 213 of the first 208 and second webs 209 and a distal surface 242 opposite the proximal surface 241 and facing away from the interior surface of the face shell. The pier 240 also includes a pier upper surface 243 that is substantially within the same plane as the upper surface 210 of the face shell 214, a pier lower surface 244 that is substantially within the same plane as the lower surface 212 of the face shell 214, a first side 245 surface that is coupled to the distal end 213 of the first web 208, and a second side surface 246 that is coupled to a distal end 213 of the second web 209. The interior surfaces 247 of the webs 208, 209, the proximal surface 241 of the pier 240, and a portion 249 of the interior surface 204 of the face shell 214 between the interior surfaces 247 of the webs 208, 209 together define a pocket.

Furthermore, the pier 240 balances the load on the face shell 214 on the side of the webs 208, 209, according to some implementations, providing additional structural stability to the building block 200 without blocking the view of the interior surface 204 of the face shell 214 and by reducing the amount of raw materials needed for the block 200.

Like the building blocks described above, building block 200 provides the advantage of being able to view and access the interior surface 204 of the building blocks that are stacked to form a wall assembly, such as is shown in FIGS. 38-41, which cannot be done using traditional building blocks or building assembly kits that provide two face shells. This access allows for a more efficient construction process by allowing various trades to install their respective systems into the wall without unnecessary scheduling burdens. In addition, this access allows building inspection professionals to inspect the various systems and structure of the building more easily.

In addition, the interior surfaces 247 of the first 208 and second webs 209 adjacent the proximal ends 211 thereof and the interior surface 204 of the single face shell 214 define first 260 and second grooves 261, respectively. The first 260 and second grooves 261 extend from the lower surfaces 226 of the first 208 and second webs 209, respectively, to first 264 and second ledges 265, respectively, disposed within the pocket 266. The first 264 and second ledges 265 are spaced between the upper 224 and lower surfaces 226 of the first 208 and second webs 209, respectively. And, the interior surfaces 247 of the first 208 and second webs 209 adjacent the distal ends 213 thereof and the proximal surface 241 of the pier 240 define third 262 and fourth grooves 263, respectively. The third 262 and fourth grooves 263 extend from the lower surfaces 226 of the first 208 and second webs 209, respectively, to third 267 and fourth ledges 268, respectively, disposed within the pocket 266. The third 267 and fourth ledges 268 are spaced between the upper 224 and lower surfaces 226 of the first 208 and second webs 209, respectively.

The upper surfaces 224 of the first 208 and second webs 209 are substantially within the same plane as the upper surface 210 of the face shell 214 and the pier upper surface 243. And, the lower surface 226 of the first 208 and second webs 209 are substantially within the same plane as the lower surface 212 of the single face shell 214 and the pier lower surface 244. In other implementations (not shown), the lower surface 226 of the first 208 and second webs 209 may be in a different plane than the lower surface 212 of the single face shell 214 and the pier lower surface 244.

Figure 19:
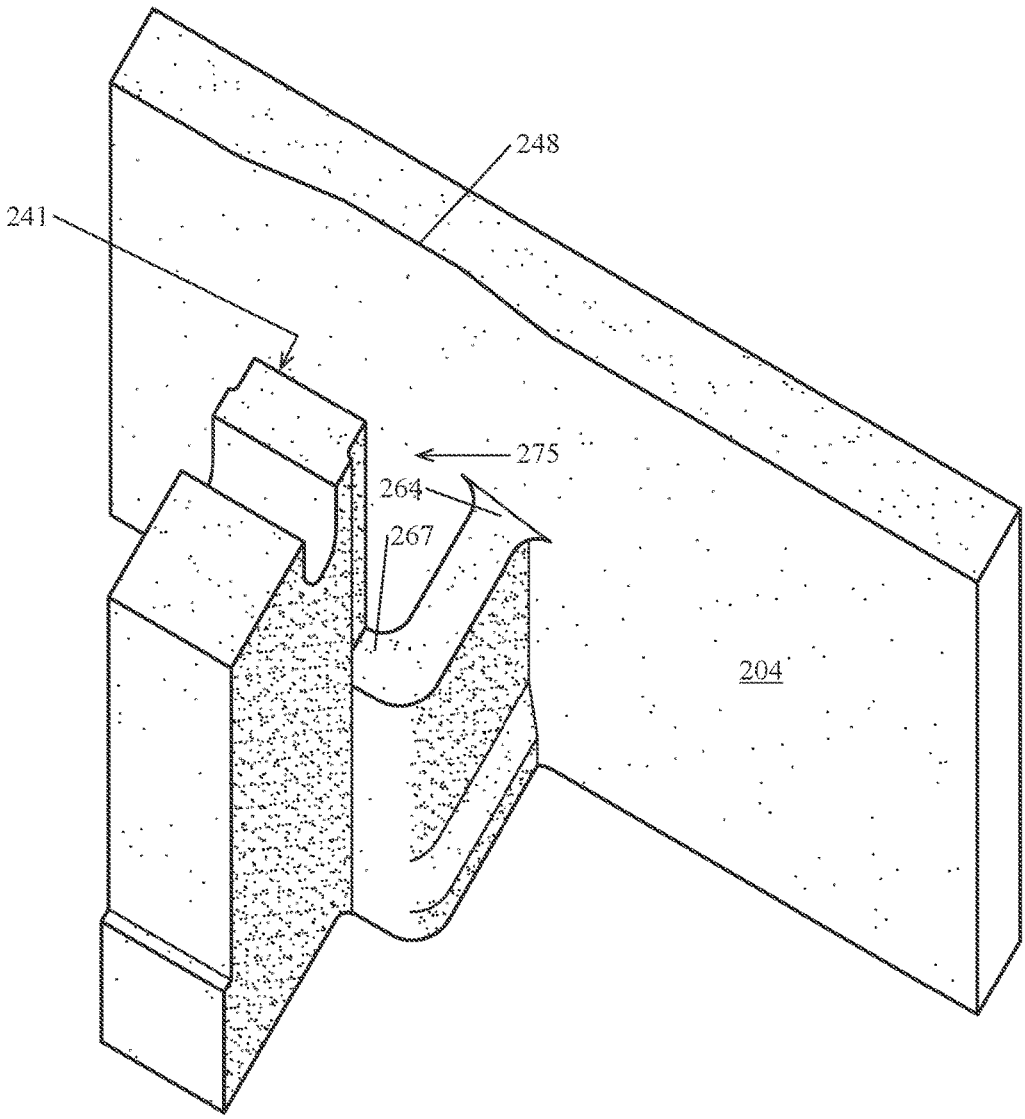
FIG. 19 illustrates a perspective view of the building block in FIG. 18 with knock out portions removed.
Figure 20:
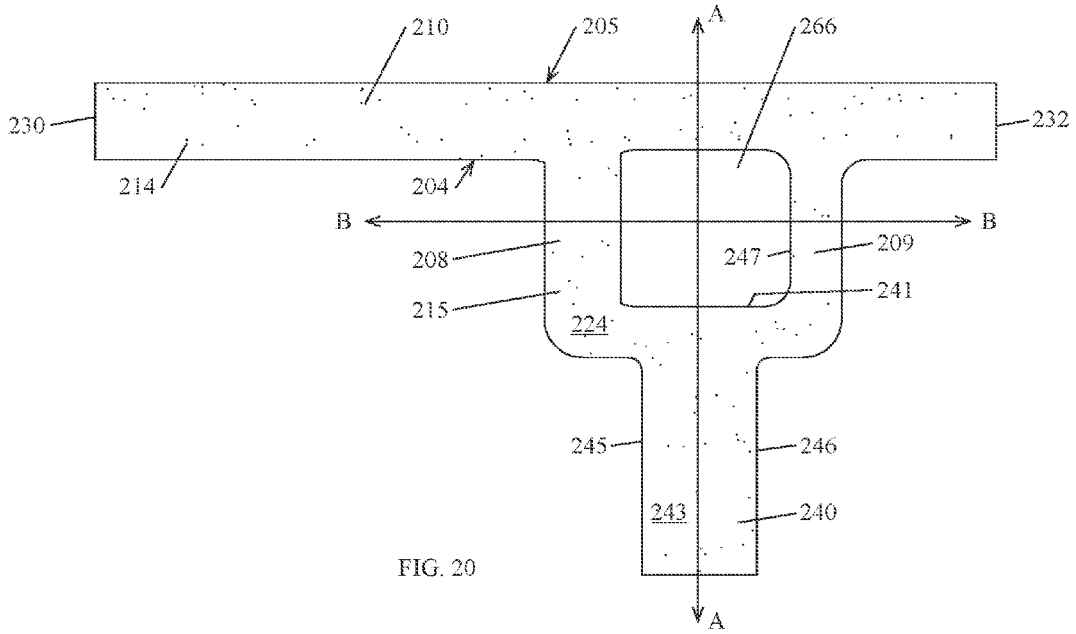
FIG. 20 illustrates a top view of the building block in FIG. 18.
Figure 21:
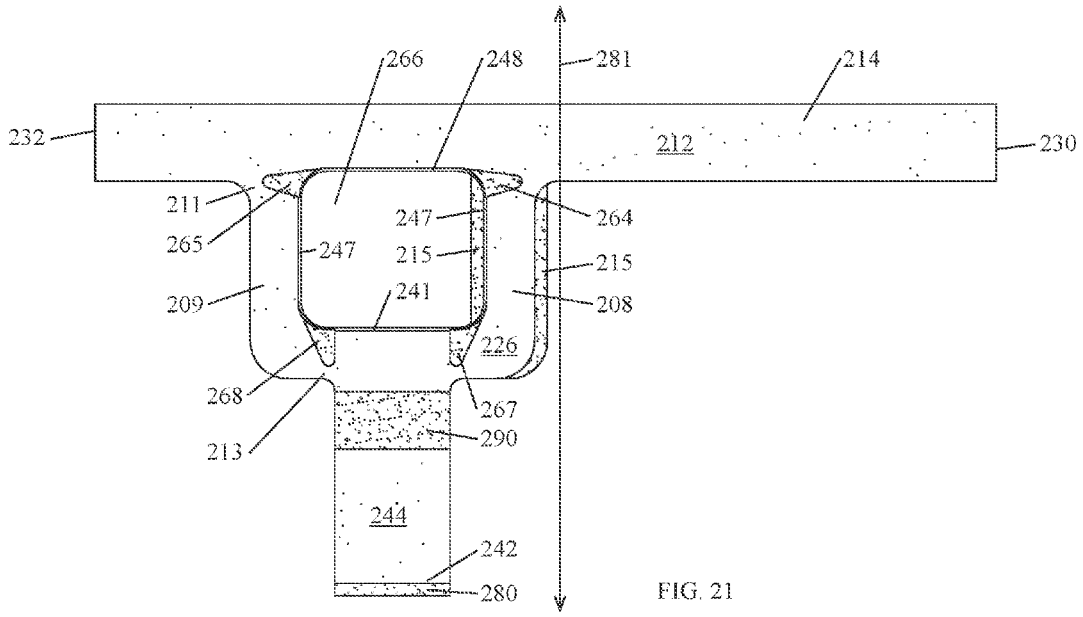
FIG. 21 illustrates a bottom view of the building block in FIG. 18.
Figure 22:
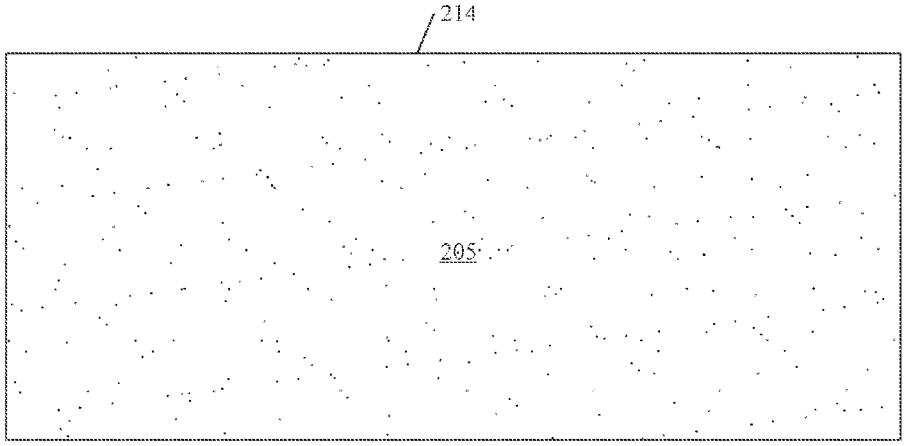
FIG. 22 illustrates a front view of the building block in FIG. 18.
Figure 23:
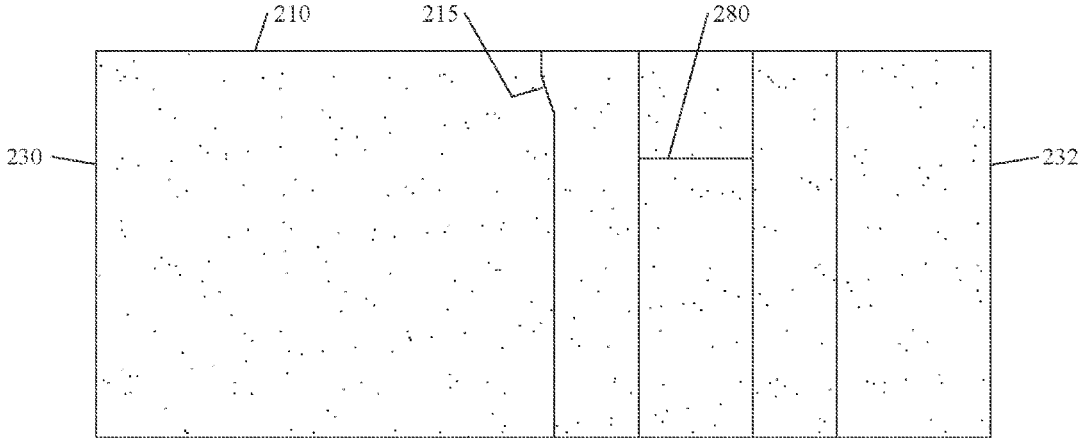
FIG. 23 illustrates a rear view of the building block in FIG. 18.
Figure 24:
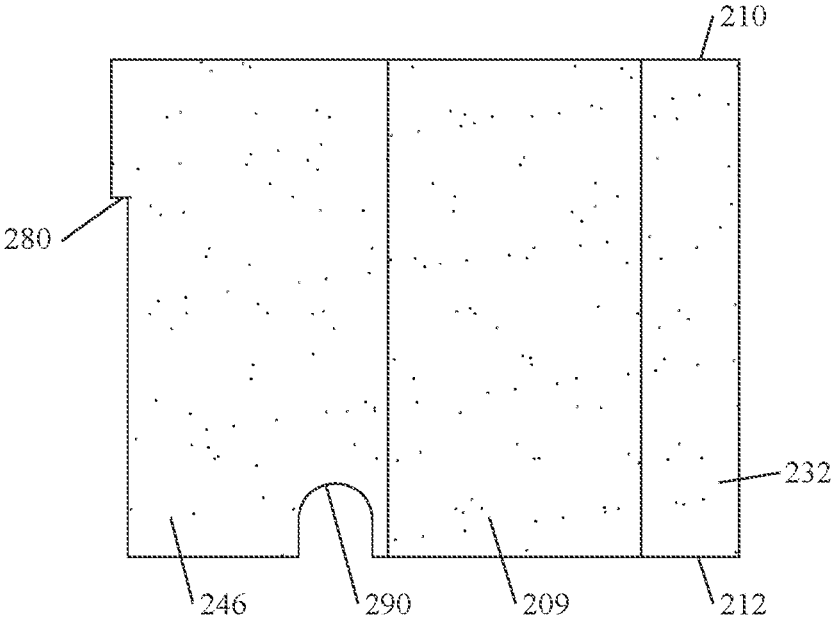
FIG. 24 illustrates a left side view of the building block in FIG. 18.
Figure 25:
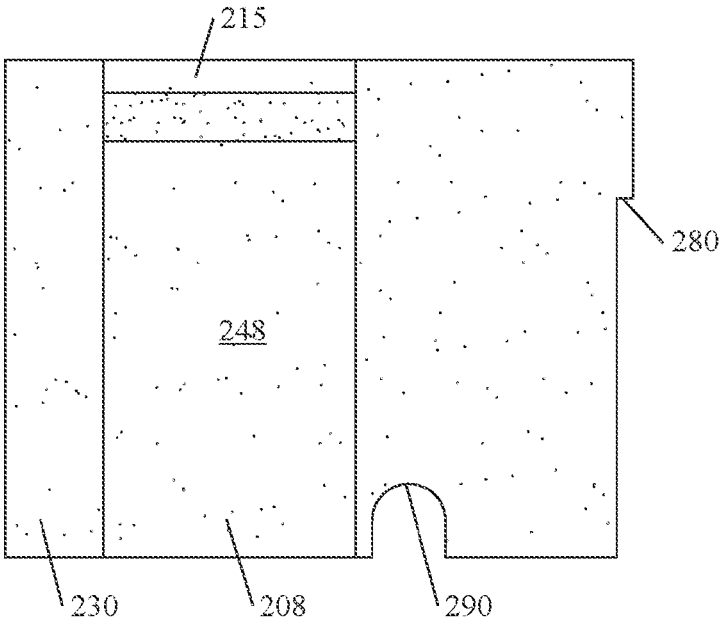
FIG. 25 illustrates a right side view of the building block in FIG. 18.
Figure 26:
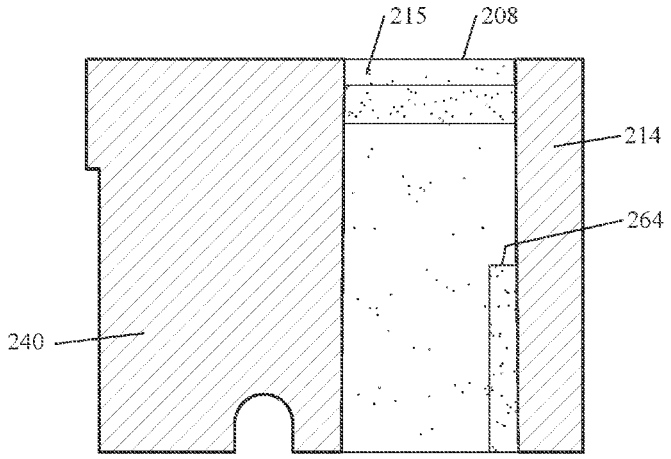
FIG. 26 illustrates a cross sectional view of the building block shown in FIG. 20 taken along the A-A axis.
Figure 27:
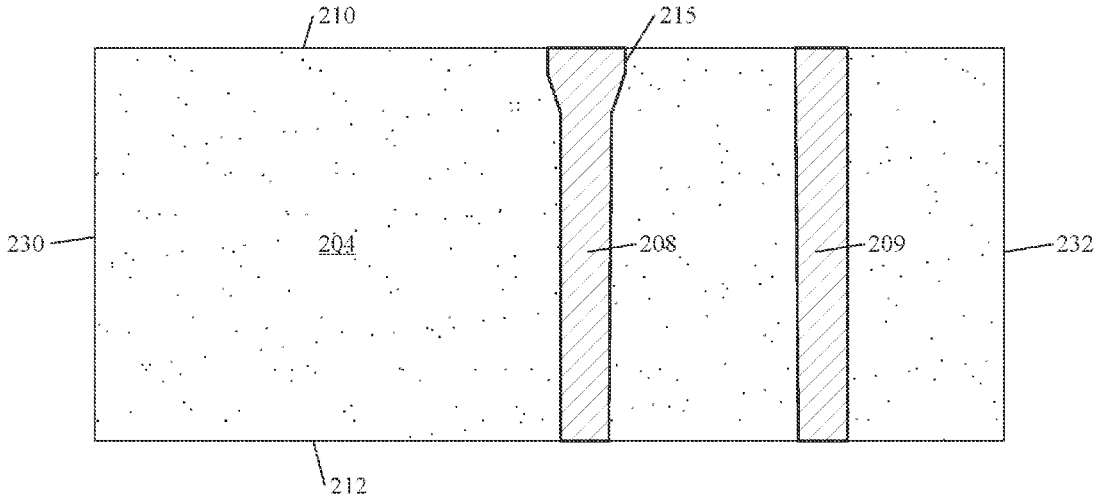
FIG. 27 illustrates a cross sectional view of the building block shown in FIG. 20 taken along the B-B axis.
Figure 28:
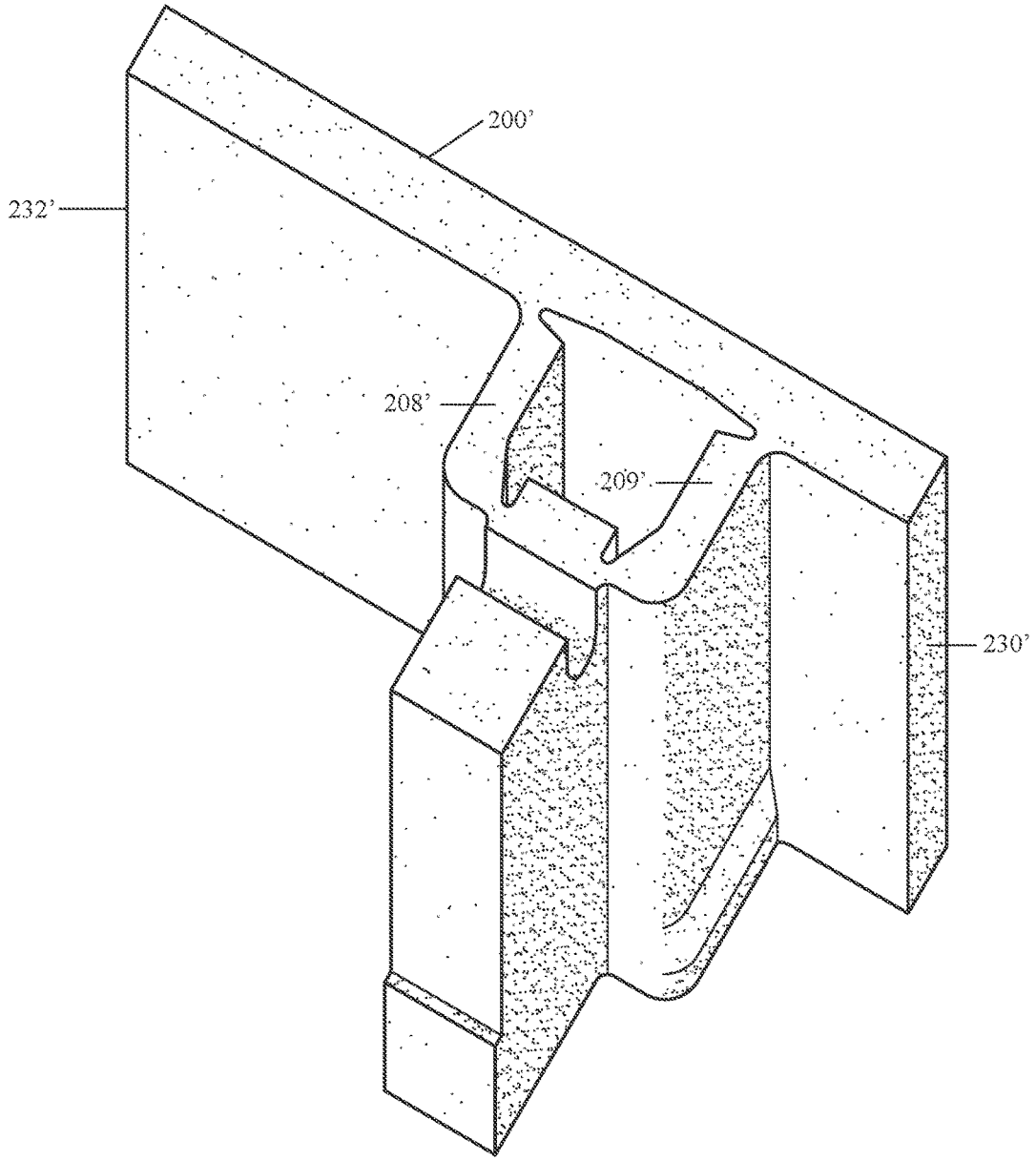
FIG. 28 illustrates a perspective view of a building block similar to the block shown in FIGS. 18-27 but with the webs closer to the first end of the block.
Figure 29:
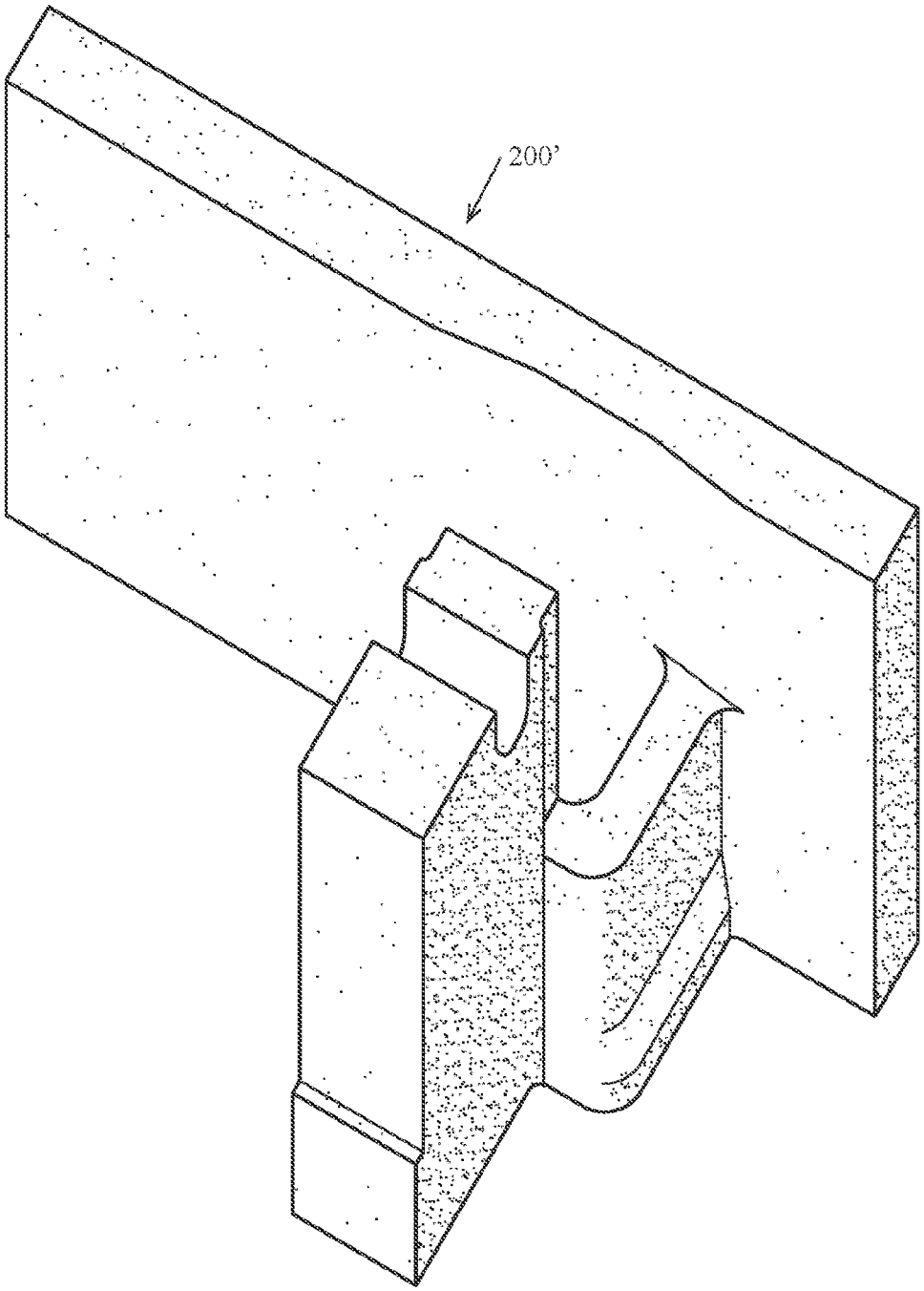
FIG. 29 illustrates a perspective view of the building block in FIG. 28 with knock out portions removed.
Figure 30:
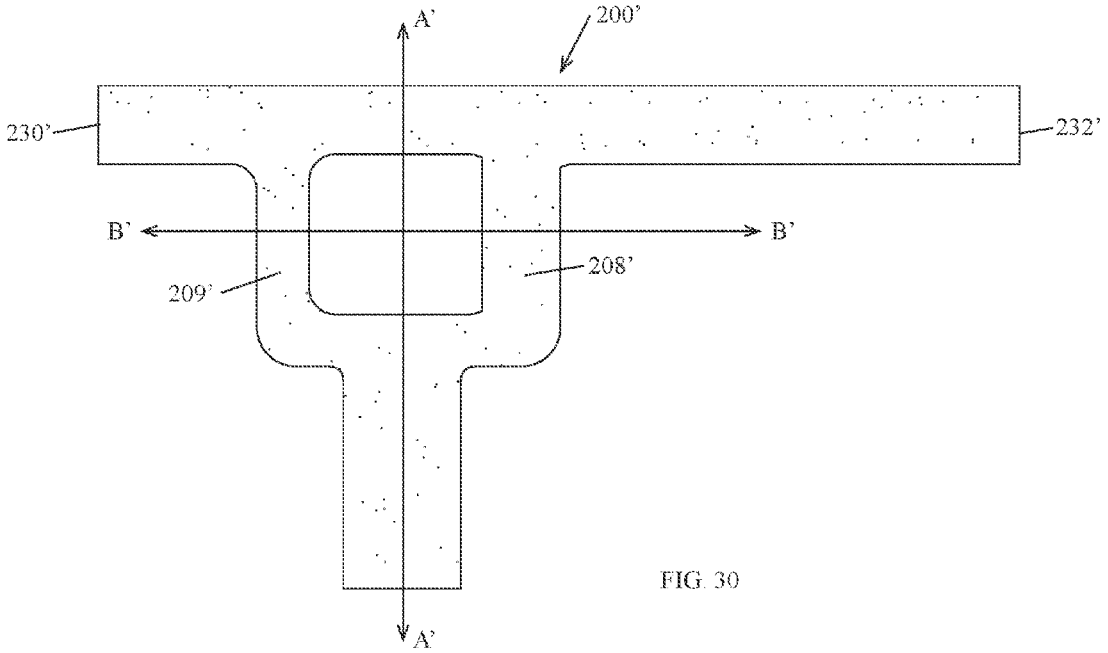
FIG. 30 illustrates a top view of the building block in FIG. 28.
Figure 31:
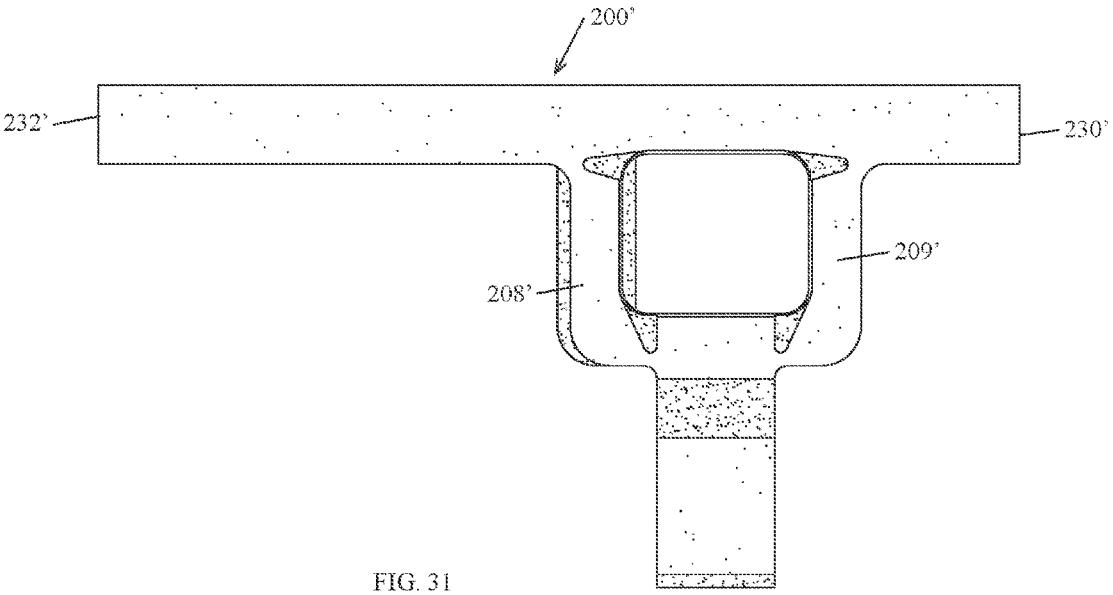
FIG. 31 illustrates a bottom view of the building block in FIG. 28.
Figure 32:
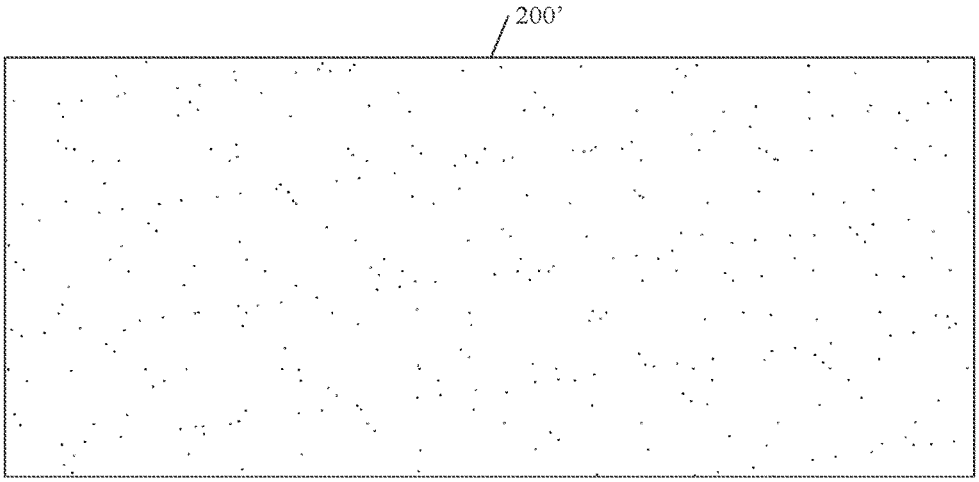
FIG. 32 illustrates a front view of the building block in FIG. 28.
Figure 33:
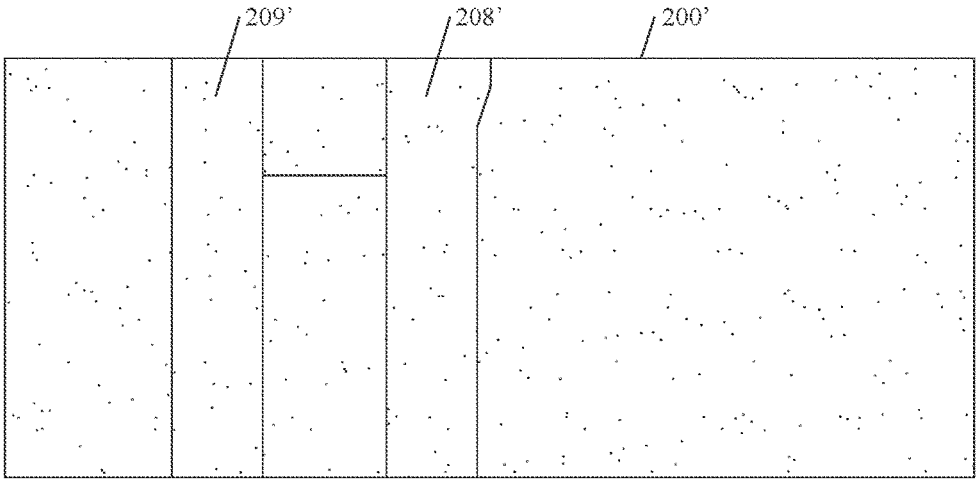
FIG. 33 illustrates a rear view of the building block in FIG. 28.
Figure 34:
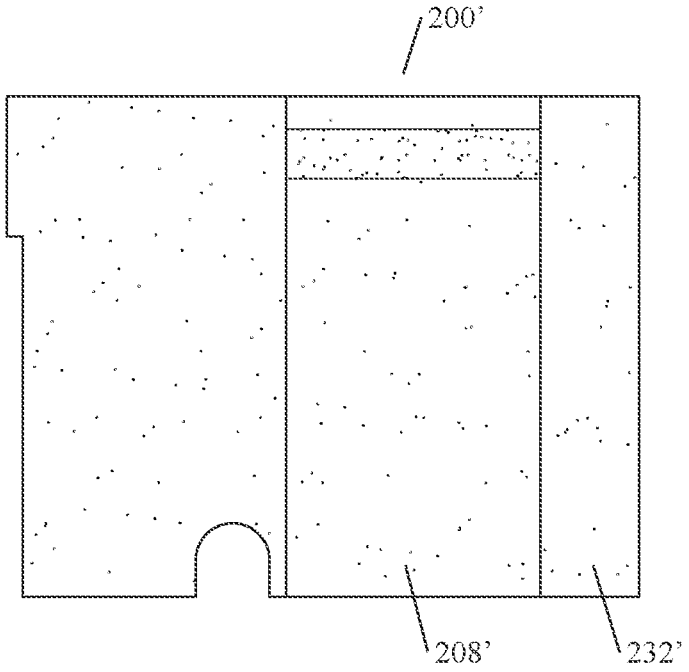
FIG. 34 illustrates a left side view of the building block in FIG. 28.
Figure 35:
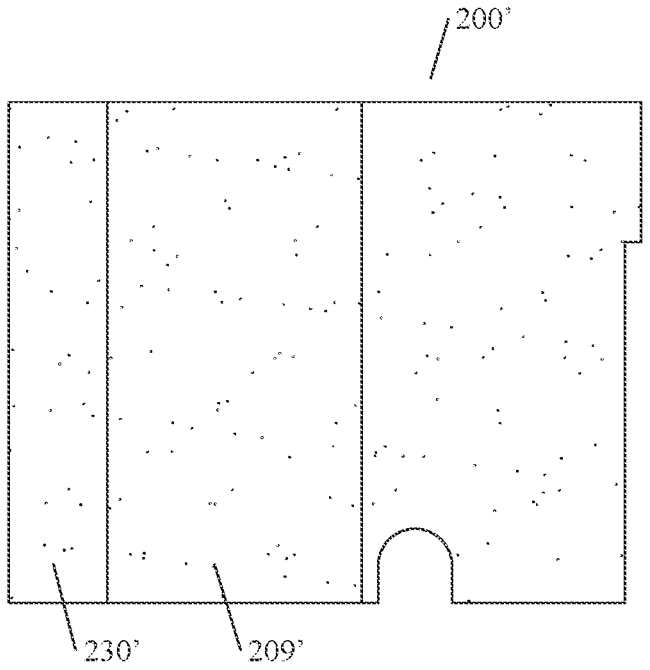
FIG. 35 illustrates a right side view of the building block in FIG. 28.
Figure 36:
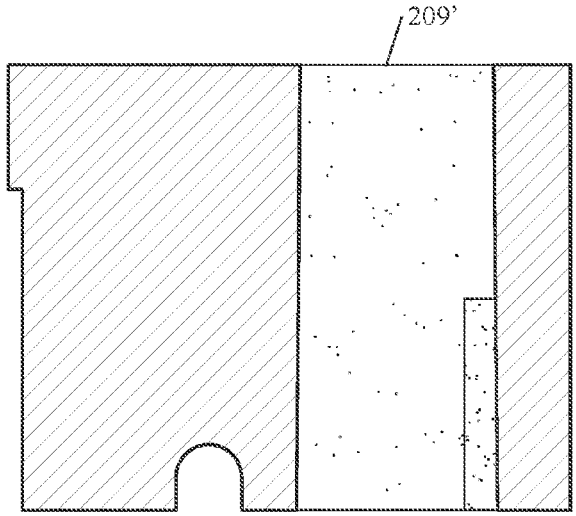
FIG. 36 illustrates a cross sectional view of the building block shown in FIG. 30 taken along the A-A axis.
Figure 37:
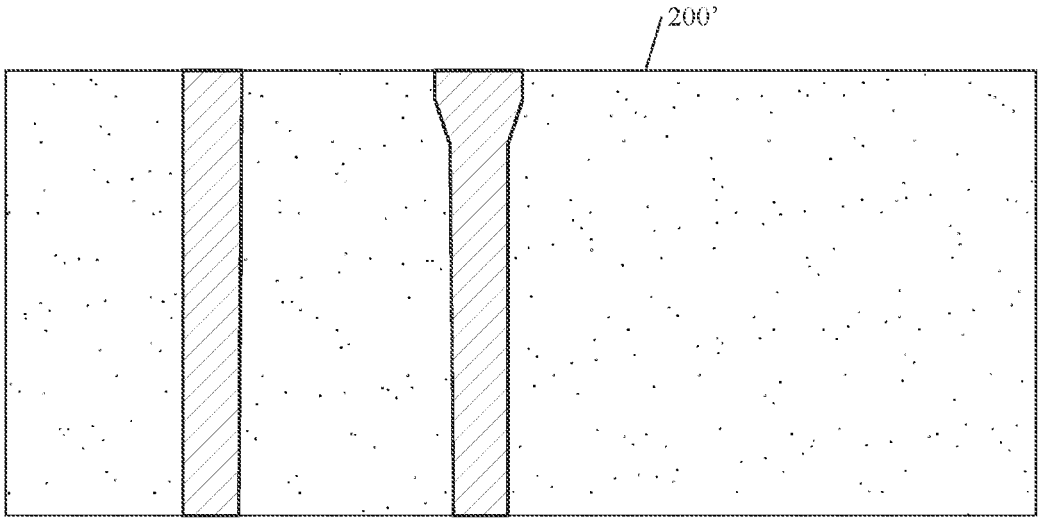
FIG. 37 illustrates a cross sectional view of the building block shown in FIG. 30 taken along the B-B axis.
Figure 38:
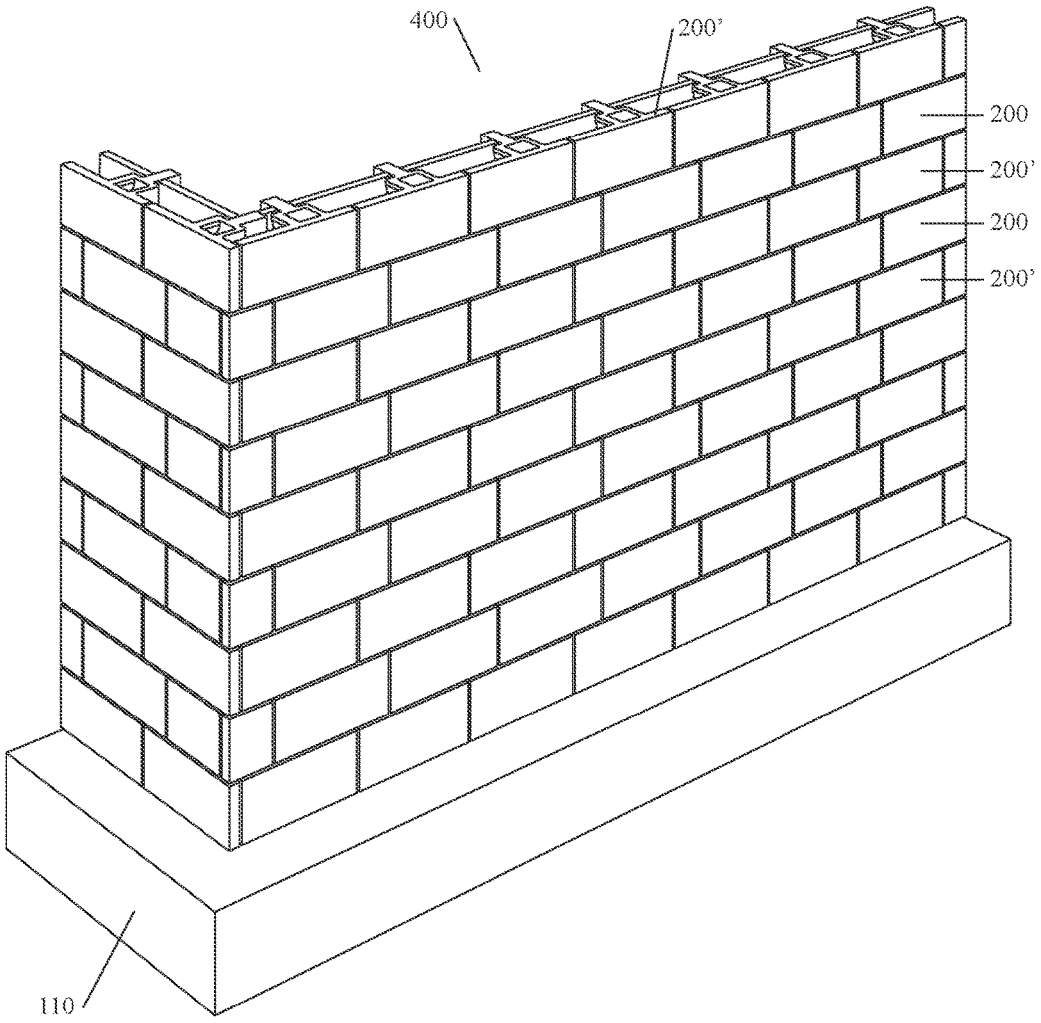
FIG. 38 illustrates a front perspective view of an assembled wall using the blocks shown in FIGS. 18-37, according to one implementation.

A first knock-out portion 270 of the first web 208 is defined between the first 260 and third grooves 262, the lower surface 226 of the first web 208, and the first 264 and third ledges 267, and a second knock-out portion 271 of the second web 209 is defined between the second 261 and fourth grooves 263, the lower surface 226 of the second web 209, and the second 265 and fourth ledges 268. These knock-out portions 270, 271 may be removed from the building block by applying blunt force to the knock-out portions 270, 271 (e.g., with a hammer or mallet) to break off the knock-out portions 270, 271 adjacent the respective ledges 264, 267, 265, 268 and grooves 260, 262, 261, 263. With the knock out portions 270, 271 removed, the proximal surface 241 of the pier 240, the new lower surfaces of the first and second webs 208, 209 (which approaches or is continuous with the ledges 264, 265, 267, 268), and the interior surface 204 of face shell 214 define a horizontal channel 275, such as is shown in FIG. 19. This horizontal channel 275 may receive a beam, such as bond beam, a steel tube, or other horizontal beam, which is described below in relation to FIGS. 39-41. In other implementations, removing the knock out portions 270, 271 allows access to the pocket 266 of the building block 200 near the building foundation (e.g., the lowermost course) to remove debris that may have fallen into the pocket 266 while laying the blocks 200. Furthermore, removing the knock out portions 270, 271 from one or more blocks may be useful for allowing for inspection of tensioning rods that may be installed in the pocket 266.

In other implementations, the grooves defining the knock out portions 270, 271 may be shaped differently, extend in other directions relative to the interior surface 247 of the webs 208, 209, and/or extend through the width of the webs 208, 209, such as is shown in the implementations in FIGS. 1 and 17A. And, in some implementations, the building block may not include grooves or knock out portions or the knock out portions may not be defined by grooves.

A ledge 280 extends from the distal surface 242 of the pier 240. The ledge 280 is spaced between the upper 243 and lower surfaces 244 of the pier 240. In some implementations, at least a portion of the ledge 280 lies in a plane that is parallel to a plane in which at least a portion of the pier upper surface 243 lies. In a further implementation, a plane in which at least a portion of the ledge 280 lies is parallel to a plane in which at least a portion of the pier lower surface 244 lies. Due to manufacturing constraints, the ledge 280 may have irregularities in its surface, resulting in a surface that is not within a single plane. In some implementations (not shown), at least a portion of the ledge 280 may be in a plane that is not parallel with a plane in which at least a portion of the pier upper surface 243 and/or lower surface 244 lie.

In some implementations, the first web defines a lifting ledge 215 adjacent the upper surface 224 of the first web 208. The lifting ledge 215 extends outwardly from the interior 247 and exterior surfaces 248 of the first web 208 in the width direction adjacent the upper surface 224 of the web 208. The lifting ledge 215 allows a mason or other user to grasp the building block 200 more easily. The lifting ledge 215 is disposed on the first web 208 because the first web 208 is closest to a center of gravity of the building block 200.

To reduce material for the building block 200 without compromising structural stability of the building block 200, the portion 248 of the single face shell 214 between the proximal ends 211 of the first 208 and second webs 209 has a thickness as measured in a thickness direction that is orthogonal to the length and width directions that is less than a thickness of a remaining portion of the single face shell 214. However, in other implementations, the thickness of the portion 248 of the face shell 214 may be substantially uniform or thicker than the other portions of the face shell 214.

In addition, the pier 240 has a width that is less than a width defined between exterior surfaces 248 of the first 208 and second webs 209. For example, in one implementation, the width of the pier 240 is between about 1.5 and about 3.5 inches (e.g., about 2.25 inches wide), and the external width of the webs 208, 209 is about 4.5 to about 6 inches (e.g., about 5.6 inches wide). As another example, the width of the pier 240 may be 30% to about 60% the external width of the webs, according to some implementations. FIGS. 45A-45D illustrates an exemplary implementation and its dimensions.

However, in other implementations, the width of the pier 240 may be greater than the width of the distance between the exterior surfaces 248 of the first 208 and second webs 209. In such implementations, the interior surface 204 of the face shell 214 remains viewable and accessible when the blocks 200 are stacked relative to each other to form a wall assembly.

In addition, the distance between the proximal surface 241 of the pier and the interior surface 204 of the face shell 214 is between about 2 and about 4 inches (e.g., about 3 inches), according to some implementations.

Figure 39:
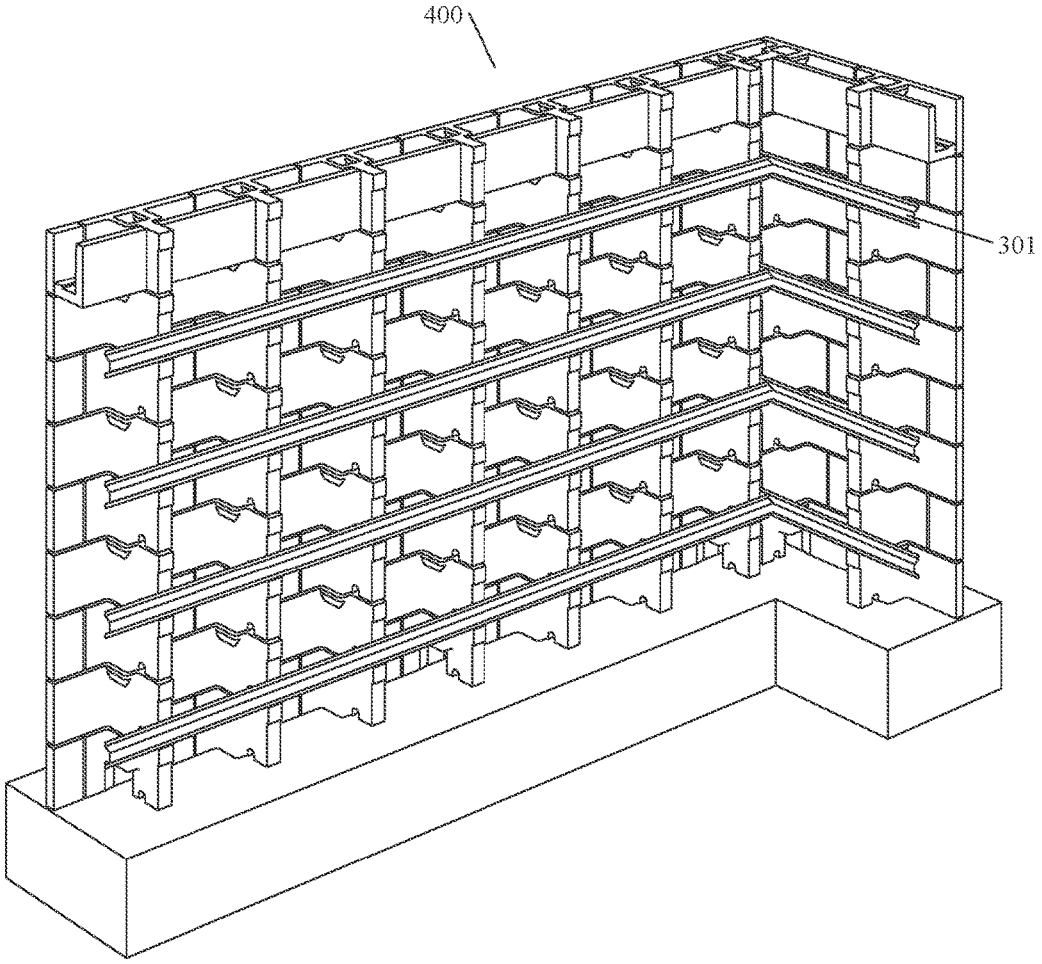
FIG. 39 illustrates a rear perspective view of the assembled wall in FIG. 38 having horizontally oriented furring channel framing.
Figure 40:
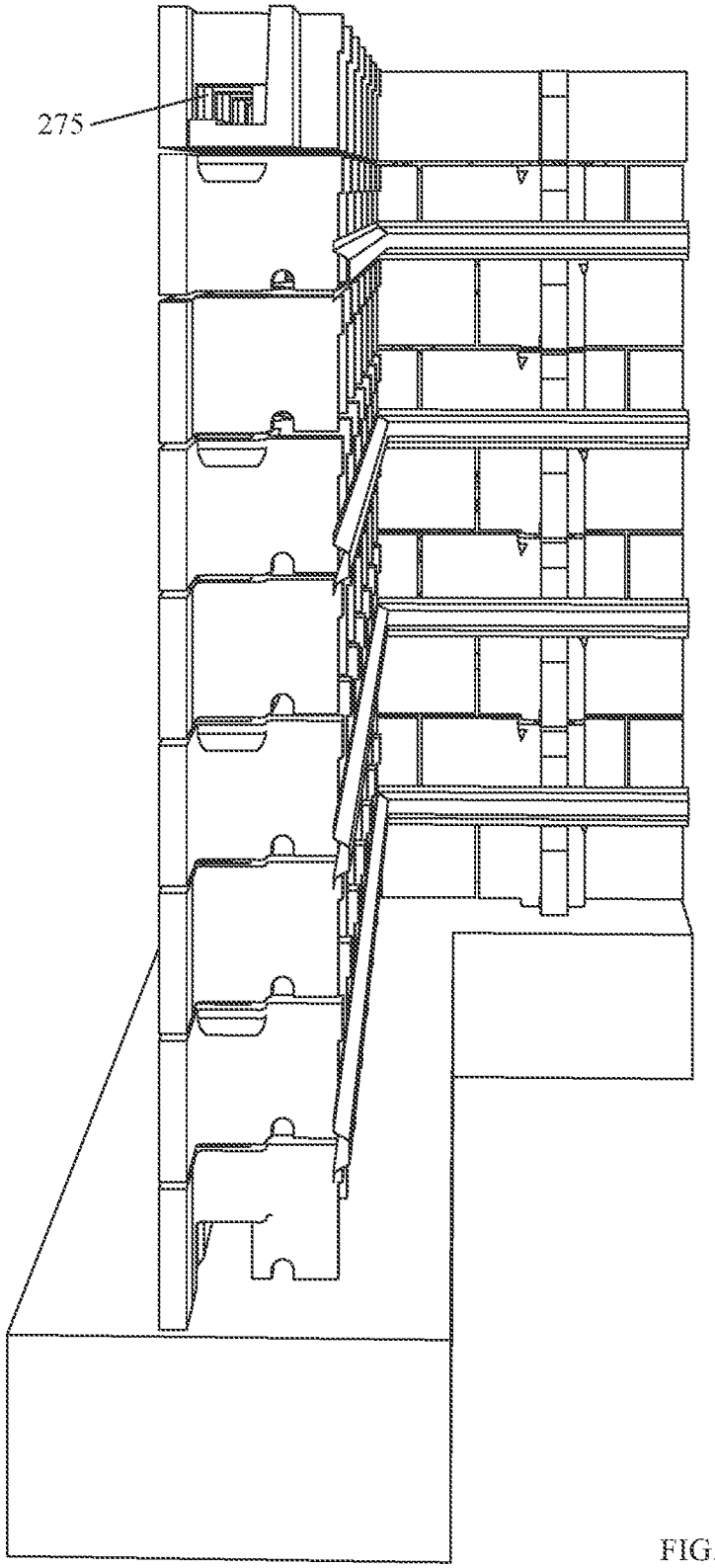
FIG. 40 illustrates a side perspective view of the assembled wall in FIG. 39.
Figure 41:
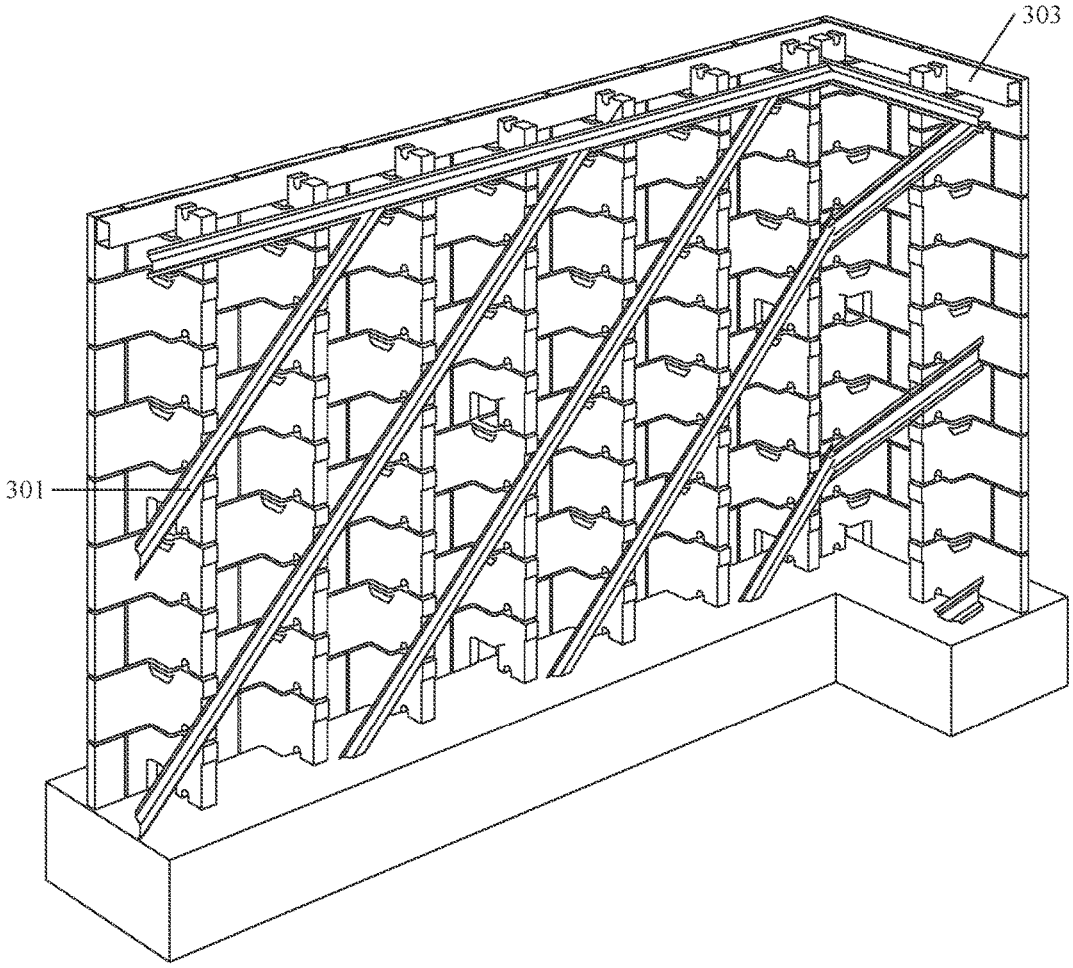
FIG. 41 illustrates a rear perspective view of the assembled wall in FIG. 38 having diagonally oriented furring channel framing.

As shown in FIGS. 38-41, a plurality of building blocks 200 are stackable together in horizontal courses to form a masonry wall 400. To assemble the wall, building blocks 200 are laid in a horizontal course on a wall foundation, such as foundation 110 described above. The next horizontal course is laid on top of this horizontal course, and so on until the desired height of the wall is reached. The building blocks 200 in the subsequently laid course are stacked upon the building blocks 200 in the previously laid course such that the webs 208, 209 and pockets 266 of the blocks 200 form a continuous column along the interior face of the wall 400. In other words, the webs 208, 209 and pockets 266 of the blocks 200 are axially aligned along an axis that extends orthogonal to the support surface on which the blocks 200 are laid. The ledge 280 of the blocks in one course, the upper surface 243 of the piers 240 in the course below, and the portion of the distal surface 242 of the pier 240 between the ledge 280 and the pier lower surface 244 define a channel extending along the wall 400. The channel extends along a horizontal axis that is generally parallel to the support surface on which the blocks 200 are laid. Furring channel framing 301 may be disposed within the channel horizontally, as shown in FIG. 39, or diagonally, as shown in FIG. 41. The channels defined between the ledges 280 in the upper course and the pier upper surfaces 243 in the lower course provide a vertical stop to prevent the furring channel framing 301 from slipping vertically or twisting after installation.

Some courses in the wall 400 may include blocks 200 that have had the knock out portions 270, 271 removed (or are removed after installation). When the blocks 200 that have the knock out portions 270, 271 removed are laid above the webs 208, 209 of a block in a course below, the upper course block 200 and the upper surface 224 of the block 200 below form a horizontal channel 275, which is shown in FIG. 40. As noted above, a beam may be disposed within the horizontal channel 275, such as the bond beam shown in FIGS. 39 and 40. The particular course may be any course along the height of a wall. For example, the horizontal channel 275 may be formed in a course that is adjacent to where flooring for a second or higher story is installed or where a roof is installed. In areas where seismic activity is higher, courses having the horizontal channel 275 may be used more frequently in the wall 400 to protect the wall 400 against shear or lateral loads due to seismic activity. The horizontal channel 275 is also configured for receiving building services (e.g., plumbing, electrical wiring/conduit) or horizontal reinforcements through it. In addition, horizontal rebar may extend through the horizontal channel 275, which may be tied to the vertical rods extending through the pockets 266. Alternatively, an upper course of blocks 200 having the knock out portions 270, 271 removed may be installed such that the upper surfaces 210 of the face shells 214 of the upper course of blocks 200 are installed to be adjacent the upper surfaces 210 of the face shells 214 of the lower course of blocks 200. This orientation allows a steel tube 303, such as shown in FIG. 41, to be received within the horizontal channel 275.

In addition, the knock out portions 270, 271 may be removed in a course near the wall foundation 110 to remove debris from the pocket 266 prior to grouting the pocket 266 and/or to inspect tensioning rods or tendons 38 that may be installed within the pocket 266. FIGS. 39-41 show such an implementation. The first 260, second 261, third 262, and fourth grooves 263 defined near the corners of the pocket 266 as described above allows the block 200 to maintain its structural stability when the first 270 and second knock out portions 271 are removed despite the block 200 not having a second face shell.

In addition, the lower surface 244 of the pier 240 defines a horizontally oriented groove 290 that extends between the first side 245 and the second side 246 of the pier 240. When blocks 200 are stacked on top of each other in horizontal courses as described above, the horizontal groove 290 of a block 200 in an upper course and the upper 243 surface 244 of the pier 240 of adjacent block 200 in a lower course define an opening. The opening is able to receive building services (e.g., plumbing, wiring) or horizontal reinforcements through it. The opening may also receive wire tie attachments for furring channel framing.

To create a staggered effect for adjacent courses in the masonry wall 400, as is shown in FIGS. 39-41, the blocks laid in a first horizontal course may include blocks 200, which have webs 208, 209 disposed to the right of a central axis 281 that is equi-spaced between the ends 230, 232 of the face shell 214 and extends orthogonally through the interior surface 204 of the face shell 214. The blocks laid in a second, vertically adjacent horizontal course may include blocks 200', which are similar to blocks 200, but includes webs 208', 209' disposed to the left of the central axis 281. Blocks 200' are shown in FIGS. 27-38. By laying blocks 200 in one course and blocks 200' in the next course, and so on, the first ends 230, 231' of the blocks 200, 200', respectively, in one course are offset from the first ends 230, 230' of the blocks 200, 200' in the adjacent courses.

Figure 42:
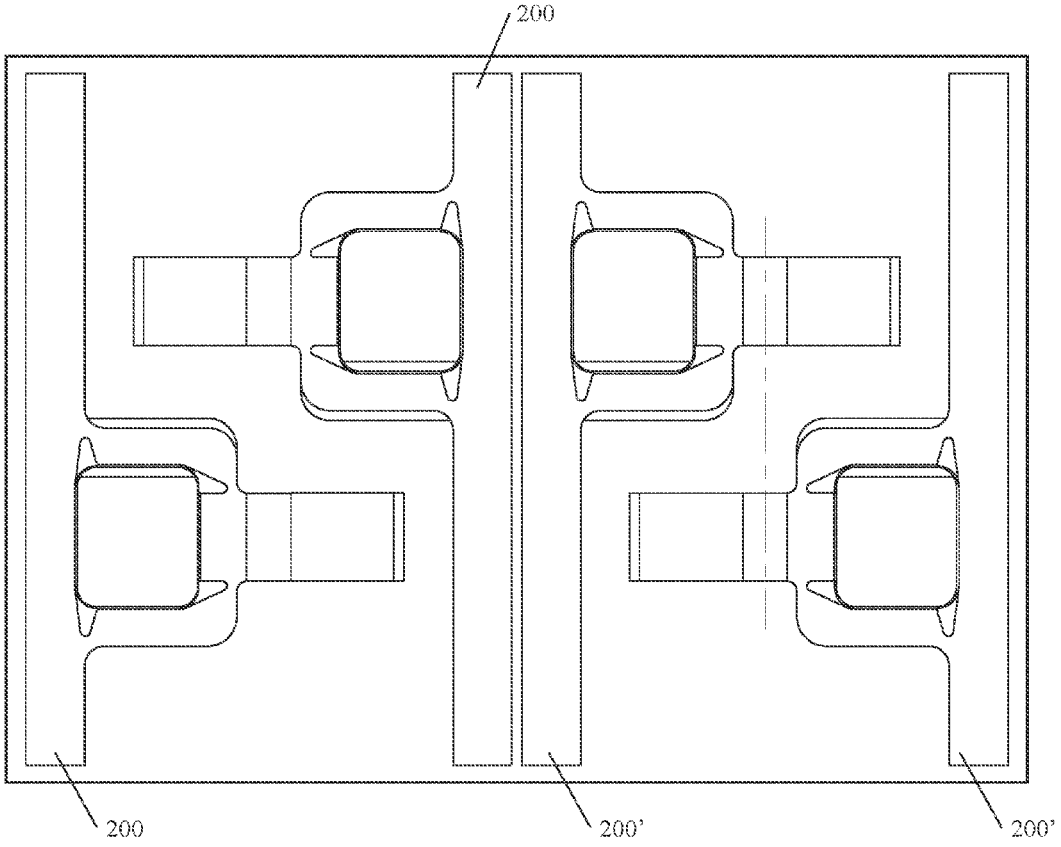
FIG. 42 illustrates a top view of a plurality of the blocks shown in FIGS. 18-37 arranged on a support structure, according to one implementation.
Figure 43:
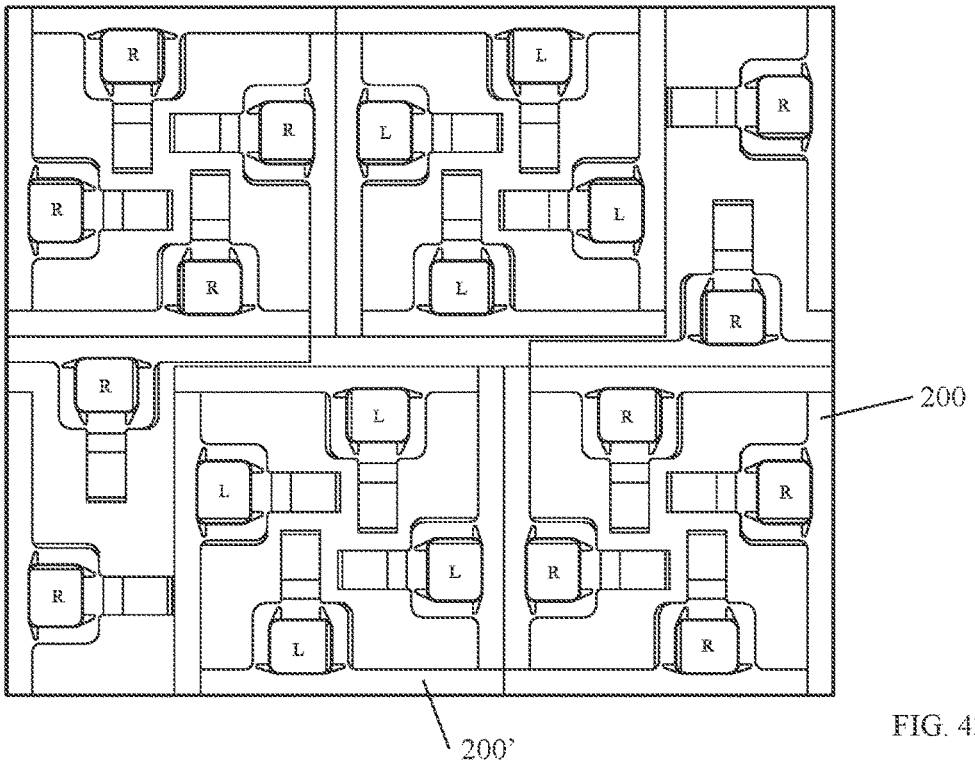
FIG. 43 illustrates a top view of a plurality of the blocks shown in FIGS. 18-37 arranged on a support structure, according to another implementation.
Figure 44:
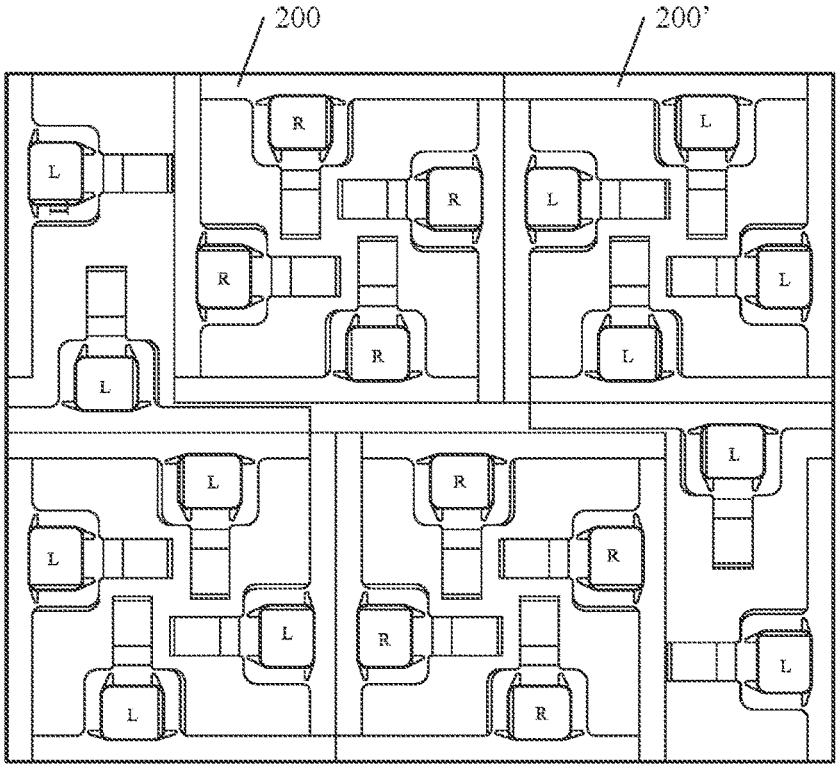
FIG. 44 illustrates a top view of a plurality of the blocks shown in FIGS. 18-37 arranged on a support structure, according to another implementation.
Figure 45A:
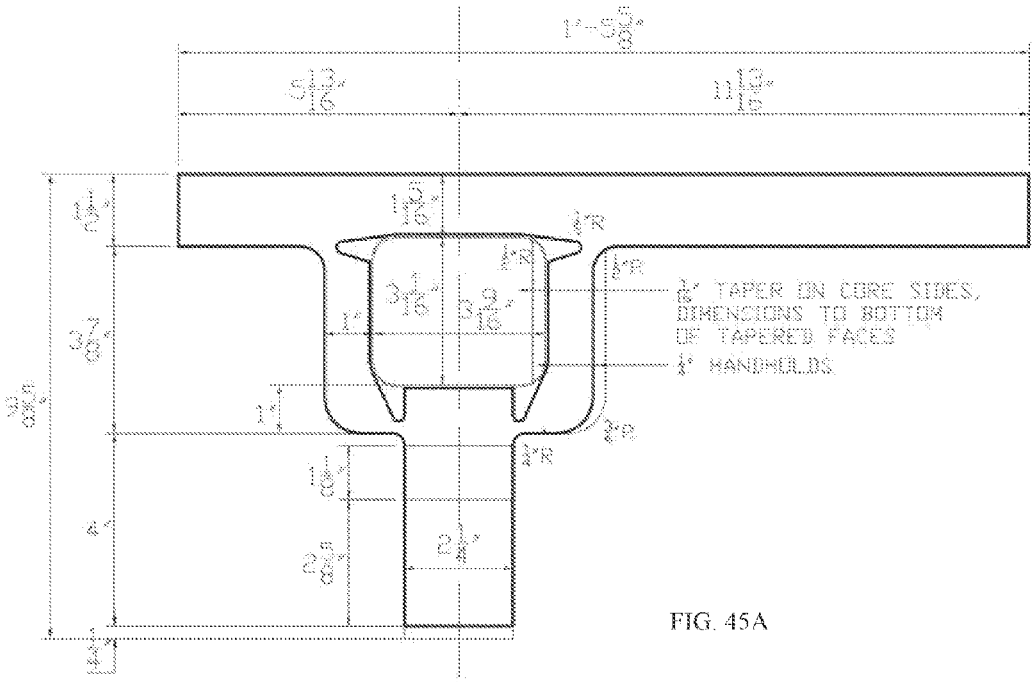
FIGS. 45A-45D illustrate a bottom, rear, perspective, and right side view of a block according to one implementation.
Figure 45B:
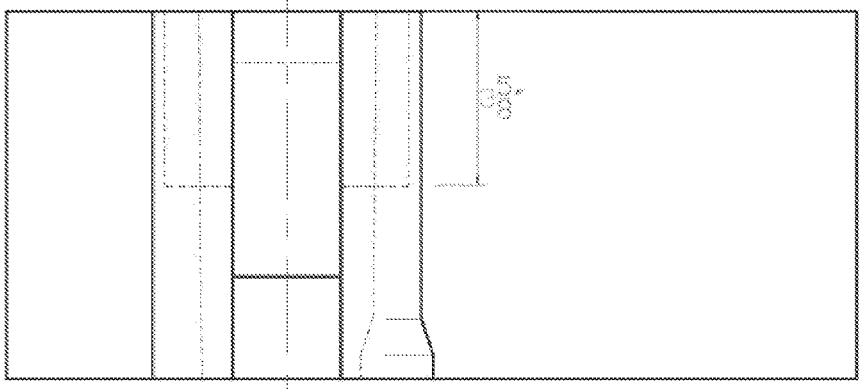
Figure 45C:
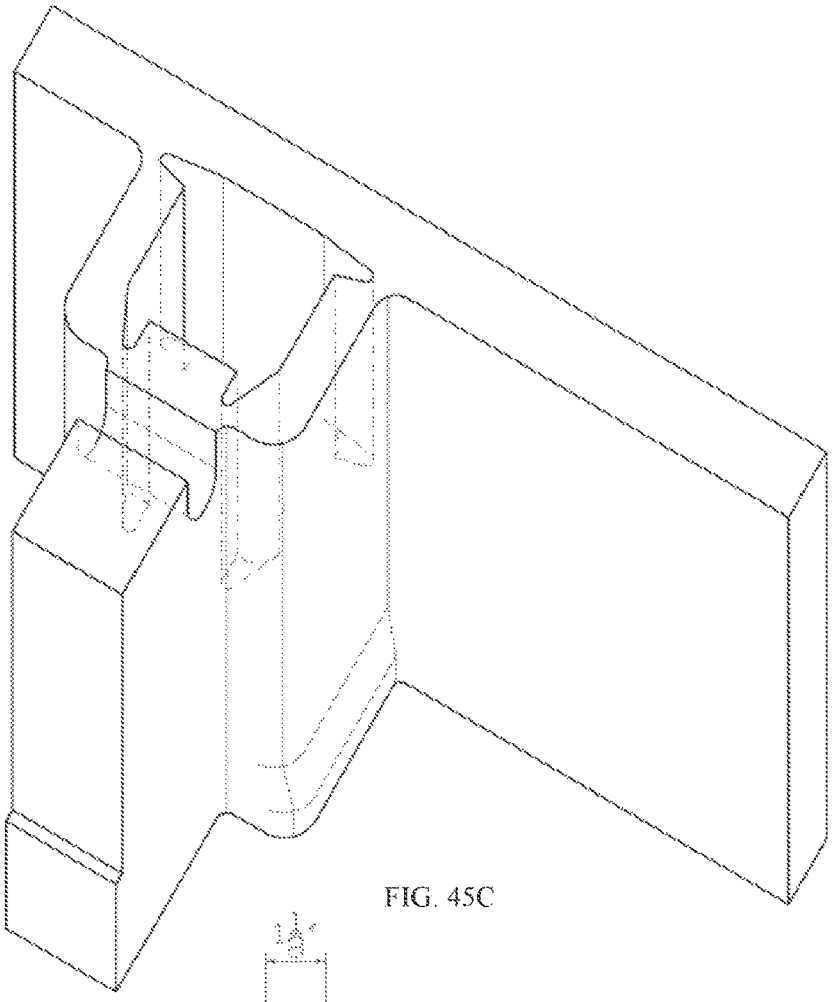
Figure 45D:
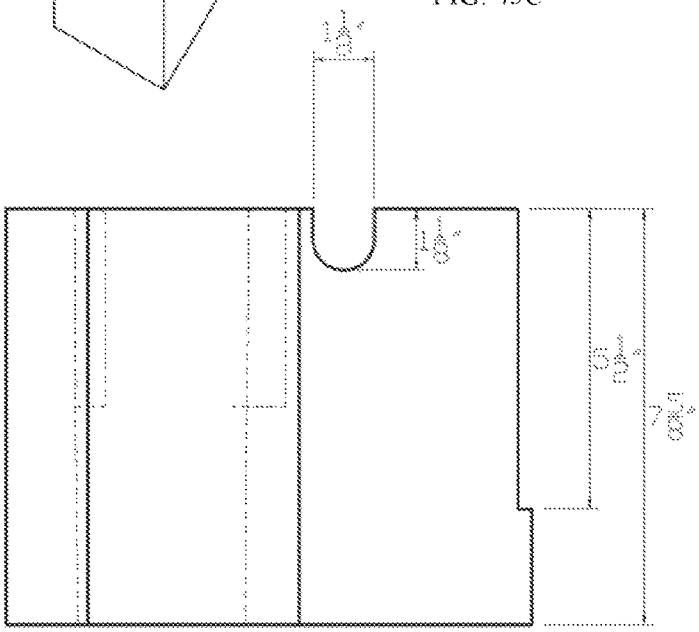

As mentioned above, the building blocks 200 may be nested together for shipping, pressing, and/or curing, which allows for more efficient manufacturing and palletizing, shipping, and/or staging. FIGS. 42-44 illustrate blocks 200, 200' nested together on a support surface, such as may be used during pressing and/or curing, or for shipping, according to various implementations.

In some implementations, the building blocks 200 laid in an upper horizontal course may be oriented 180° from the blocks 200 laid in the adjacent course below. And, in some implementations, the webs 208, 209 and pier 240 are oriented about the central axis 281. Furthermore, in some implementations, the blocks 200 may be stacked in the same orientation.

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

Furthermore, it is to be understood that the methods and systems are not limited to specific methods or specific components. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to practice various implementations of the invention. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

What is claimed is:

1. A building block comprising:

a single face shell having an interior surface and an exterior surface that are opposite and spaced apart from each other, a first end and a second end that are opposite and spaced apart from each other, and an upper surface and a lower surface that are opposite and spaced apart from each other, wherein the interior surface and exterior surface extend between the first and second ends and the upper and lower surfaces;

a first web and a second web extending from the interior surface of the single face shell, and wherein each of the first web and the second web comprises a proximal end and a distal end, the proximal ends of the first and second webs being spaced inwardly from the first and second ends of the single face shell, and the proximal ends of the first and second webs being coupled to the interior surface of the single face shell; and a pier having a proximal surface adjacent the distal ends of the first and second webs, a distal surface opposite the proximal surface and facing away from the interior surface of the single face shell, a pier upper surface that is substantially within the same plane as the upper surface of the single face shell, a pier lower surface that is substantially within the same plane at the lower surface of the single face shell, a first side surface that is coupled to the distal end of the first web, and a second side surface that is coupled to a distal end of the second web, wherein the first and second side surfaces are spaced apart from each other and extend between the pier upper and pier lower surfaces, wherein interior surfaces of the webs, the proximal surface of the pier, and a portion of the interior surface of the face shell between the interior surfaces of the first and second webs together define a pocket, and wherein a ledge extends from the distal surface of the pier in a direction away from the interior surface of the single face shell, the ledge being spaced between the upper and lower surfaces of the pier.

2. The building block of claim 1, wherein:

the interior surfaces of the first and second webs adjacent the proximal ends thereof and the interior surface of the single face shell define first and second grooves, respectively, and the first and second grooves extend from the lower surfaces of the first and second webs, respectively, to first and second interior ledges, respectively, disposed within the pocket, the first and second interior ledges being spaced between the upper and lower surfaces of the first and second webs, respectively, and the interior surfaces of the first and second webs adjacent the distal ends of thereof and the proximal surface of the pier define third and fourth grooves, respectively, and the third and fourth grooves extend from the lower surfaces of the first and second webs, respectively, to third and fourth interior ledges, respectively, disposed within the pocket, the third and fourth interior ledges being spaced between the upper and lower surfaces of the first and second webs, respectively.

3. The building block of claim 2, wherein a first knock-out portion of the first web is defined between the first and third grooves, the lower surface of the first web, and the first and third interior ledges, and a second knock-out portion of the second web is defined between the second and fourth grooves, the lower surface of the second web, and the second and fourth interior ledges.

4. The building block of claim 1, wherein the upper surfaces of the first and second webs are substantially within the same plane as the upper surface of the single face shell and the pier upper surface.

5. The building block of claim 4, wherein the lower surface of the first and second webs are substantially within the same plane as the lower surface of the single face shell and the pier lower surface.

6. The building block of claim 1, wherein the lower surface of the first and second webs are substantially within the same plane as the lower surface of the single face shell and the pier lower surface.

7. The building block of claim 1, wherein the plane in which at least a portion of the ledge lies is substantially parallel to a plane in which at least a portion of the upper surface of the pier lies.

8. The building block of claim 1, wherein the interior surface of the single face shell comprises a center line that extends between the upper and lower surfaces of the single face shell and is equi-spaced between the first and second ends of the face shell, and the proximal ends of the first and second webs are disposed between one of the first and second ends of the single face shell and the center line.

9. The building block of claim 1, wherein the lower surface of the pier defines a horizontally oriented groove that extends between the first side and the second side of the pier.

10. The building block of claim 1, wherein an exterior surface of the first web defines a lifting ledge adjacent the upper surface of the first web, the lifting ledge extends outwardly from the interior and the exterior surfaces of the first web in a direction parallel to a second axis, wherein the second axis extends through the first and second ends of the single face shell.

11. The building block of claim 1, wherein the portion of the single face shell between the proximal ends of the first and second webs has a thickness, as measured in a direction parallel to a first axis, that is less than a thickness of a remaining portion of the single face shell, wherein the first axis is orthogonal to the interior surface of the single face shell.

12. The building block of claim 1, wherein the pier has a width that is less than a width defined between exterior surfaces of the first and second webs, the exterior surfaces being spaced apart and opposite from the interior surfaces of the respective web, wherein width is measured in a direction parallel to a second axis that extends through the first and second ends of the single face shell.

13. A masonry wall comprising a plurality of building blocks stacked in horizontal courses, each building block comprising:

a single face shell having an interior surface and an exterior surface that are opposite and spaced apart from each other, a first end and a second end that are opposite and spaced apart from each other, and an upper surface and a lower surface that are opposite and spaced apart from each other, wherein the interior surface and exterior surface extend between the first and second ends and the upper and lower surfaces;

a first web and a second web extending from the interior surface of the single face shell, and wherein each of the first web and the second web comprises a proximal end and a distal end, the proximal ends of the first and second webs being spaced inwardly from the first and second ends of the single face shell, and the proximal ends of the first and second webs being coupled to the interior surface of the single face shell; and a pier having a proximal surface adjacent the distal ends of the first and second webs, a distal surface opposite the proximal surface and facing away from the interior surface of the single face shell in a direction parallel to a first axis, a pier upper surface that is substantially within the same plane as the upper surface of the single face shell, a pier lower surface that is substantially within the same plane at the lower surface of the single face shell, a first side surface that is coupled to the distal end of the first web, and a second side surface that is coupled to a distal end of the second web, wherein the first and second side surfaces are spaced apart from each other and extend between the pier upper and pier lower surfaces, and wherein the planes in which the pier upper and pier lower surfaces lie are substantially parallel to each other, wherein:

interior surfaces of the webs, the proximal surface of the pier, and a portion of the interior surface of the face shell between the interior surfaces of the first and second webs together define a pocket, a ledge extends from the distal surface of the pier in the direction away from the interior surface of the single face shell parallel to the first axis, wherein the ledge is spaced between the pier upper and pier lower surfaces, and the plurality of building blocks comprises a first building block in a first horizontal course and a second building block in a second horizontal course, wherein the first building block is stacked upon the second building block such that the webs and pockets of the first and second building blocks form a column and a channel is defined by the ledge of the first building block, the pier upper surface of the second building block, and a portion of the distal surface of the pier of the first building block between the ledge and the pier upper surface of the first building block.

14. The masonry wall of claim 13, wherein a plane in which at least a portion of the ledge lies is substantially parallel to a plane in which at least a portion of the pier upper surface lies.

15. The masonry wall of claim 14, wherein the plane in which the portion of the ledge lies is substantially parallel to a plane in which a portion of the pier lower surface lies.

16. The masonry wall of claim 13, wherein a plane in which at least a portion of the ledge lies is substantially parallel to a plane in which at least a portion of the pier lower surface lies.

17. The masonry wall of claim 13, further comprising a furring channel framing, the furring channel framing being disposed horizontally within the channel defined between the first and second building blocks.

18. The masonry wall of claim 13, further comprising a furring channel framing, the furring channel framing being disposed diagonally within the channel defined between the first and second building blocks.

19. The masonry wall of claim 13, wherein for each building block, the interior surfaces of the first and second webs adjacent the proximal ends thereof and the interior surface of the single face shell define first and second grooves, respectively, and the first and second grooves extend from the lower surfaces of the first and second webs, respectively, to first and second interior ledges, respectively, disposed within the pocket, the first and second interior ledges being spaced between the upper and lower surfaces of the first and second webs, respectively, and the interior surfaces of the first and second webs adjacent the distal ends of thereof and the proximal surface of the pier define third and fourth grooves, respectively, and the third and fourth grooves extend from the lower surfaces of the first and second webs, respectively, to third and fourth interior ledges, respectively, disposed within the pocket, the third and fourth interior ledges being spaced between the upper and lower surfaces of the first and second webs, respectively.

20. The masonry wall of claim 19, wherein:

for each building block, a first knock-out portion of the first web is defined between the first and third grooves, the lower surface of the first web, and the first and third interior ledges, and a second knock-out portion of the second web is defined between the second and fourth grooves, the lower surface of the second web, and the second and fourth interior ledges, and for building blocks in a particular course of the masonry wall, the first and second knock out portions are removed such that the lower surfaces of the webs are adjacent the first, second, third, fourth interior ledges, and the proximal surfaces of the piers, the lower surfaces of the webs with the knock out portions removed, and the interior surfaces of the single face shells in the particular course together define a horizontal beam channel along the particular course.

21. The masonry wall of claim 20, further comprising a beam, the beam being disposed within the horizontal beam channel.

22. The masonry wall of claim 13, wherein, for each building block, the interior surface of the single face shell comprises a center line that extends between the upper and lower surfaces of the single face shell and is equi-spaced between the first and second ends, and the proximal ends of the first and second webs of a first set of building blocks are disposed between the first end of the single face shell and the center line and the proximal ends of the first and second webs of a second set of building blocks are disposed between the second end of the single face shell and the center line, wherein blocks from the first set are laid in a first horizontal course, and blocks from the second set are laid vertically adjacent the first course in a second horizontal course.

23. The masonry wall of claim 22, wherein the pockets of building blocks in adjacent courses are aligned and stacked to form continuous columns.

24. The masonry wall of claim 13, wherein, for each building block, the portion of the single face shell between the proximal ends of the first and second webs has a thickness as measured in a direction parallel to the first axis that is less than a thickness of a remaining portion of the single face shell, wherein the first axis is orthogonal to the interior surface of the face shell.

25. The masonry wall of claim 13, wherein, for each building block, the pier has a width that is less than a width defined between exterior surfaces of the first and second webs, wherein width is measured in a direction parallel to a second axis that extends through the first and second ends of the single face shell.

26. The masonry wall of claim 13, wherein the lower surface of the pier of each building block defines a horizontally oriented groove that extends between the first side and the second side of the pier, and the pier upper surface of the second building block and the horizontally oriented groove of the second building block define a utility channel.

* * * * *